US006933812B2

(12) United States Patent
Sarabandi et al.

(10) Patent No.: US 6,933,812 B2
(45) Date of Patent: Aug. 23, 2005

(54) ELECTRO-FERROMAGNETIC, TUNABLE ELECTROMAGNETIC BAND-GAP, AND BI-ANISOTROPIC COMPOSITE MEDIA USING WIRE CONFIGURATIONS

(75) Inventors: Kamal Sarabandi, Ann Arbor, MI (US); Hossein Mosallaei, Ann Arbor, MI (US)

(73) Assignee: The Regents of the University of Michigan, Ann Arbor, MI (US)

( * ) Notice: Subject to any disclaimer, the term of this patent is extended or adjusted under 35 U.S.C. 154(b) by 0 days.

(21) Appl. No.: 10/683,065

(22) Filed: Oct. 10, 2003

(65) Prior Publication Data

US 2005/0146402 A1 Jul. 7, 2005

Related U.S. Application Data

(60) Provisional application No. 60/417,435, filed on Oct. 10, 2002.

(51) Int. Cl.[7] ..... H01P 7/00
(52) U.S. Cl. ..... 333/219; 333/205
(58) Field of Search ..... 333/202, 219, 333/219.1, 204, 235, 205

(56) References Cited

U.S. PATENT DOCUMENTS 4,121,182 A * 10/1978 Makimoto et al. ..... 333/205
4,641,116 A * 2/1987 Shibata et al. ..... 333/204
5,057,803 A * 10/1991 Ooi et al. ..... 333/204
5,990,766 A 11/1999 Zhang et al.
6,686,817 B2 * 2/2004 Zhu et al. ..... 333/205
6,791,432 B2 * 9/2004 Smith et al. ..... 333/99 S

OTHER PUBLICATIONS

Bayindir M. Et al. "Transmission Properties of Composite Metamaterials in Free Space", Applied Physics Letters, American Institute of Physics, New York, U.S. vol. 81, No. 1, Jul. 1, 2002, pp. 120-122, XP001124494 ISSN: 0003-6951 p. 120, right-hand column, line 14-p. 121, left-hand column, line 30; figures 1A-C.

(Continued)

*Primary Examiner*—Seungsook Ham
(74) *Attorney, Agent, or Firm*—Young & Basile, P.C.

(57) ABSTRACT

An artificial electro-ferromagnetic meta-material demonstrates the design of tunable band-gap and tunable bi-anisotropic materials. The medium is obtained using a composite mixture of dielectric, ferro-electric, and metallic materials arranged in a periodic fashion. By changing the intensity of an applied DC field the permeability of the artificial electro-ferromagnetic can be properly varied over a particular range of frequency. The structure shows excellent Electromagnetic Band-Gap (EBG) behavior with a band-gap frequency that can be tuned by changing the applied DC field intensity. The building block of the electro-ferromagnetic material is composed of miniaturized high Q resonant circuits embedded in a low-loss dielectric background. The resonant circuits are constructed from metallic loops terminated with a printed capacitor loaded with a ferro-electric material. Modifying the topology of the embedded-circuit, a bi-anisotropic material (tunable) is examined. The embedded-circuit meta-material is treated theoretically using a transmission line analogy of a medium supporting TEM waves.

31 Claims, 17 Drawing Sheets

OTHER PUBLICATIONS

Hrabar S. Et. Al. "Simplified Analysis of Split Ring Resonator Used in Backward Meta-Material", IX-TH International Conference on Mathematical Methods in Electromagnetic Theory—Proceedings, vol. 2, Sep. 10-13, 2002, pp. 560-562, XP010619667 KIEV, p. 562, line 1-4; figure 4.

Sarabandi K. et al. "Novel Artificial Embedded Circuit Meta-Material for Design of Tunable Electro-Ferromagnetic Permeability Medium"; 2003 IEEE MTT-S International Microwave Symposium—Digest, Jun. 8-13, 2003, pp. 2061-2064, XP002268593 Philadelphia (US) the whole document.

D. Sievenpiper, L. Zhang, R. F. J. Broas, N. G. Alexópoulos, and E. Yablonovitch, "High-impedance electromagnetic surfaces with a forbidden frequency band,"*IEEE Trans. Microwave Theory Tech.,* vol. 47, No. 11, pp. 2059-2074, Nov. 1999.

D. R. Smith, W. J. Padilla, D. C. Vier, S. C. Nemat-Nasser, and S. Schultz, "Composite medium with simultaneously negative permeability and permittivity,"*Phys. Rev. Lett.,* vol. 84, No. 18, pp. 4184-4187, May 2000.

J. B. Pendry, A. J. Holden, D. J. Robbins, and W. J. Stewart, "Magnetism from conductors and enhanced nonlinear phenomena,"*IEEE Trans. Microwave Theory Tech.,* vol. 47, No. 11, pp. 2075-2084, Nov. 1999.

H. Mosallaei and Y. Rahmat-Samii, "Periodic band-gap and effective dielectric materials in electromagnetics: Characterization and applications in nanocavities and waveguides,"*to be Published in IEEE Trans. Antennas Propagat*, 2002.

H. Mosallaei, and Y. Rahmat-Samii, "Composite materials with negative permittivity and permeability properties: Concept, analysis, and characterization,"*IEEE AP-S International Symposium*, Boston, Massachusetts, Jul. 8-13, 2001.

A. Oliner, "A periodic-structure negative-refractive-index medium without resonant elements,"*IEEE AP-S International Symposium*, San Antonio, Texas, Jun. 16-21, 2002.

R. Ziolkowski, "Double negative material design, experiments, and applications,"*IEEE AP-S International Symposium*, San Antonio, Texas, Jun. 16-21, 2002.

C. Caloz, and T. Itoh, "Application of the transmission line theory of Left-Handed (LH) materials to the realization of a microstrip LH line,"*IEEE AP-S International Symposium*, San Antonio, Texas, Jun. 16-21, 2002.

A. K. Iyer, and G. V. Eleftheriades, "Negative refractive index metamaterials supporting 2-D waves,"*IEEE MTT-S International Symposium*, Seattle, Washington, Jun. 2-7, 2002.

M. S. Klushkens and E. H. Newman, "A microstrip line on a chiral substrate,"*IEEE Trans. Microwave Theory Tech.,* vol. 39, No. 11, pp. 1889-1891, Nov. 1991.

N. Engheta and P. Pelet, "Reduction of surface waves in chirostrip antennas,"*Electronics Lett.,* vol. 27, No. 1, pp. 5-7, Jan. 1991.

D. Pozar, "Microstrip antennas and arrays on chiral substrates,"*IEEE Trans. Antennas Propagat.,* vol. 40, No. 10, pp. 1260-1263, Oct. 1992.

H. Mosallaei and Y. Rahmat-Samii, "Broadband characterization of complex periodic EBG structures: An FDTD/Prony technique based on the split-field approach,"*to be Published in Electromagnetics*, 2003.

A. Tombak, J.P. Maria, F. Ayguavives, Z. Jin, G. Stauf, A. I. Kingon, and A. Mortazawi, "Tunable Barium Strontium Titanate thin film capacitors for RF and microwave applications,"*Microwave and Wireless Componnets Lett.,* vol. 12, pp. 3-5, Jan. 2002.

A. Tombak, J.P. Maria, F. T. Ayguavives, Z Jin, G. T. Stauf, A. I. Kingon, and A. Mortazawi, "Voltage-Controlled RF Filters Employing Thin-Film Barium-Strontium-Titanate Tunable Capacitors"*Microwave Theory and Techniques*. vol. 51, No. 2, Feb. 2003.

* cited by examiner

FIG. 15B
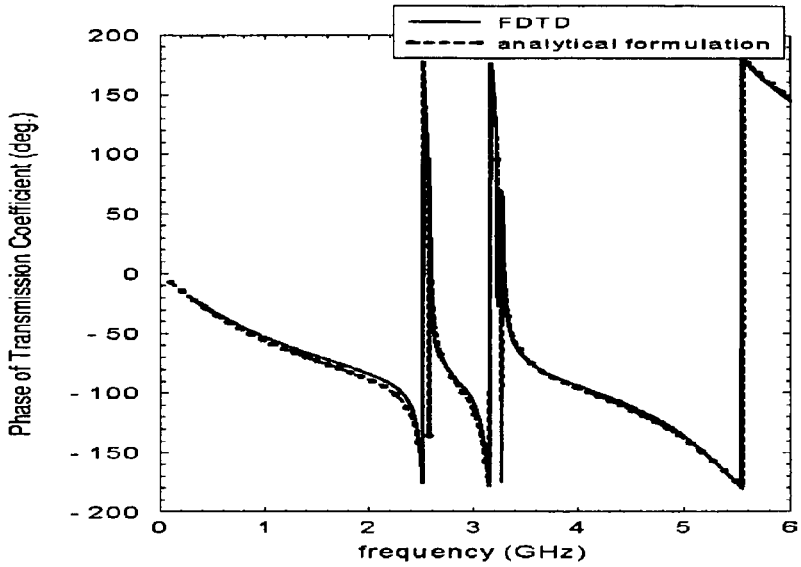
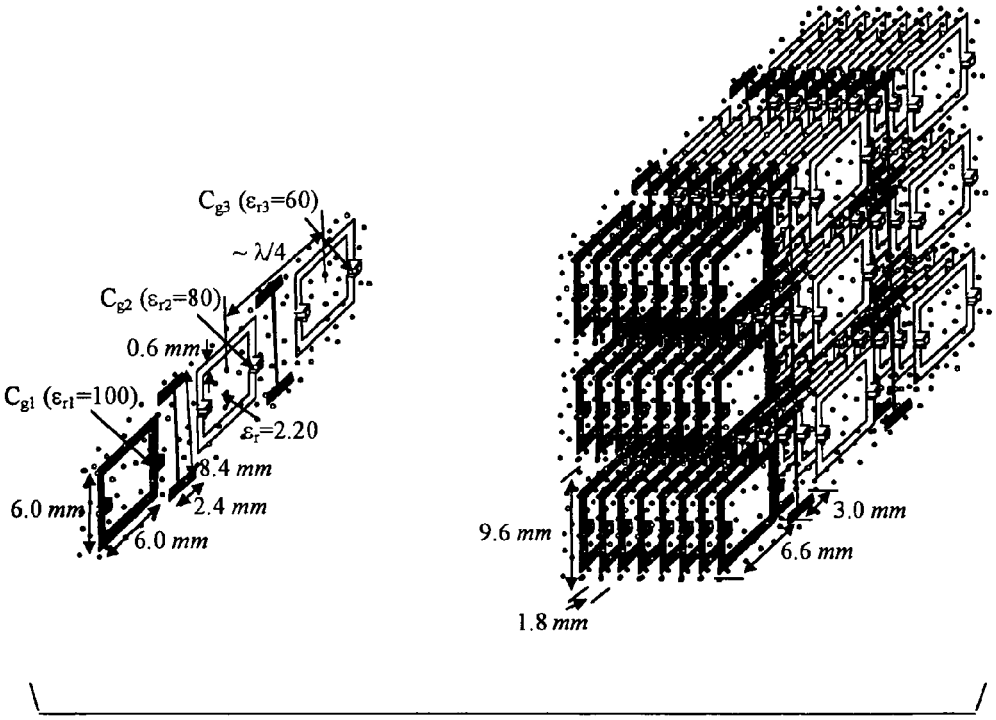
FIG. 16

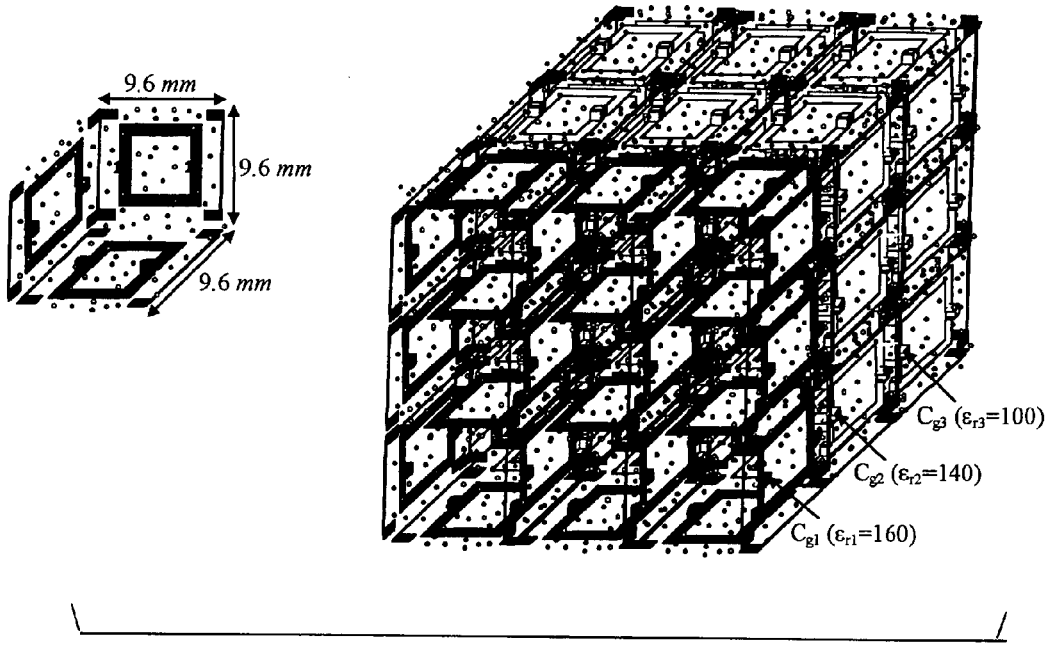
FIG. 19
FIG. 20
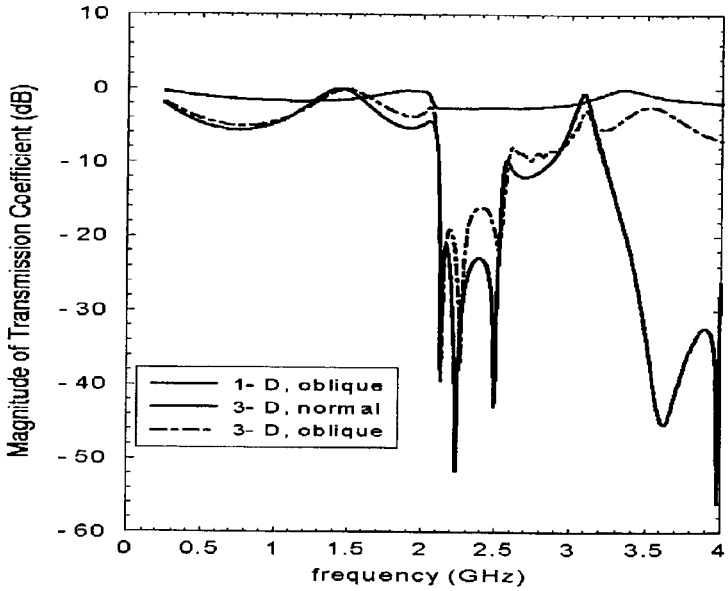

ELECTRO-FERROMAGNETIC, TUNABLE ELECTROMAGNETIC BAND-GAP, AND BI-ANISOTROPIC COMPOSITE MEDIA USING WIRE CONFIGURATIONS

RELATED APPLICATIONS

This application claims the benefit of provisional application Ser. No. 60/417,435 filed on Oct. 10, 2002 and incorporates that application in its entirety by reference.

STATEMENT REGARDING FEDERALLY SPONSORED RESEARCH OR DEVELOPMENT

The U.S. Government has a paid-up license in this invention and the right in limited circumstances to require the patent owner to license others on reasonable terms as provided for by Grant No. DARPA N000173-01-1G910.

FIELD OF THE INVENTION

The focus in the present invention is to investigate the unique properties of a novel tunable periodic structure composed of conducting wire loops printed on dielectric material and the proposed structure has the potential to be integrated in introducing three unique structures, namely, electro-ferromagnetic structures, band-gap materials, and bi-anisotropic media.

BACKGROUND OF THE INVENTION

In a sense, every material can be considered as a composite, even if the individual ingredients consist of atoms and molecules. The main objective in defining the permittivity $\epsilon$ and permeability $\mu$ for a medium is to present a microscopic view of the electromagnetic properties of the structure. Therefore, it is not surprising, if one replaces the atoms and molecules of the original composite with structures that are larger in scale, but still small compared to the wavelength to achieve an artificial meta-material with new electromagnetic functionality. The word "meta-materials" refers to materials beyond (the Greek word "meta") the ones that could be found in nature.

Using the available materials in nature, one can easily obtain a dielectric medium with almost any desired permittivity; however, the atoms and molecules of natural materials or their mixtures prove to be a rather restrictive set when one tries to achieve a desired permeability at a desired frequency. This is particularly true in gigahertz range where the magnetic response of most materials vanishes. The ability to design materials with both $\epsilon$ and $\mu$ parameters would represent significant potential for advancing certain areas in wireless technology. In a paper, Pendry et al. showed that by embedding a metallic structure in the form of two concentric split rings (split-ring resonators), a medium with magnetic property could be achieved. However, the analysis presented is based on properties of an isolated split-ring resonator, that is, the effect of mutual interaction among the resonators once arranged in a periodic fashion is ignored. Thus the effective medium parameters so obtained are incorrect for the periodic medium. In addition, the geometry of split-ring resonator is not optimal for the design of artificial $\mu$ materials.

SUMMARY OF THE INVENTION

In the present invention the concept and a method for realizing electro-ferromagnetic and miniaturized tunable electromagnetic band-gap meta-materials are presented. In addition analytical and numerical methods for designing such materials with desired characteristics are developed. The proposed meta-materials offer novel electromagnetic material functionalities that do not exist naturally. These include tunable permeability, electromagnetic band-gap, and bi-anisotropic material properties at any desired frequency controlled by an applied DC electric field.

The building block of a meta-material is composed of proper arrangement of dielectric, magnetic, and metallic structures in such a way that novel material characteristics are achieved. The main challenge in the development of meta-materials is to tailor the distribution of permittivity $\epsilon(x, y, z)$, permeability $\mu(x, y, z)$, and conductivity $\sigma(x, y, z)$ within each unit cell to form a unique periodic composite medium with new effective constitutive parameters such that the medium exhibits prescribed electromagnetic (EM) properties. Artificial materials may be designed to cover a wide range of effective constitutive parameters at any desired frequency, including: (a) positive $\epsilon_{eff}$ and positive $\mu_{eff}$, (b) negative $\epsilon_{eff}$ and positive $\mu_{eff}$, (c) negative $\epsilon_{eff}$ and negative $\mu_{eff}$ and (d) positive $\epsilon_{eff}$ and negative $\mu_{eff}$. A material with positive effective permittivity ($\epsilon_{eff}$) and positive effective permeability ($\mu_{eff}$) can support a positive and real propagation constant ($\kappa=\omega\sqrt{\mu_{eff}\epsilon_{eff}}$) indicating wave propagation in the medium. For a material with negative $\epsilon_{eff}$ or $\mu_{eff}$ the propagation constant becomes purely imaginary, meaning that the medium is incapable of supporting propagating waves. Negative effective permittivity or permeability is usually observed over a limited bandwidth, which is usually referred to as the band-gap region. In situations where both $\epsilon_{eff}$ and $\mu_{eff}$ are negative simultaneously, the propagation constant is real but has a negative sign. These types of materials are known as the Left-Handed (LH) or Double Negative (DNG) media in which the directions of phase velocity and Poynting vector are anti-parallel.

The present invention uses a periodic structure of embedded resonant circuits to generate a $\mu$ material, which is simpler to fabricate. Analytical formulations for $\epsilon_{eff}$ and $\mu_{eff}$ of such medium are derived that account for mutual interaction among the embedded resonators. Variations of embedded metallic structures are also considered which can yield multi-band-gap or bi-anisotropic properties. Additionally, by loading the capacitive gaps with ferro-electric materials, it is shown that by changing a DC electric field in such medium, the effective permeability, behavior of band-gap(s), or bi-anisotropic parameters can be tuned electronically. The accuracy of the analytical results is verified using a general purpose full-wave finite difference time domain (FDTD) method.

In the following sections, the basic concept and the required tools to characterize the performance of miniaturized multifunctional embedded-circuit meta-materials is discussed. In the present invention, the concepts and analysis of an artificial tunable electro-ferromagnetic meta-material composed of periodic miniaturized high Q resonant embedded-circuits loaded with ferro-electric materials are demonstrated. The effective medium parameters of the proposed meta-material present new figures of merit and novel functionalities including tunable m-material at high frequencies, electro-ferromagnetism, tunable band-gap material, wide band-stop band-gap material, and tunable bi-anisotropic material. Simple analytical formulations based on the transmission line method are developed for designing such meta-materials. The results are verified using a powerful FDTD full wave technique with PBC/PML boundary conditions.

The physics behind the concepts of the embedded-circuit meta-material in generating electro-ferromagnetism, tunable band-gap, and bi-anisotropicity is clearly demonstrated to pave the road for future novel embedded-circuit materials. The electronic tunability of the aforementioned embedded-circuit medium is accomplished through the application of ferro-electric materials (BST varactors).

It is shown that the proposed embedded-circuit meta-material can be used to design miniaturized band-gap structure capable of producing significant isolation (greater than 20 dB) over a fraction of the wavelength. Special attention is given to increase the bandwidth of the stop-band. The design of an EBG composed of 3 layer periodic resonant circuits with dissimilar but close resonant frequencies having a wide band-stop performance is illustrated. Quarter-wave impedance inverters are used between the resonant circuits, which enables merger of the three poles in the spectral response of the effective permeability. To miniaturize the physical size, the $\lambda/4$ invertors are designed in a high e section using I-shaped metallic strips printed on the low dielectric material. The I-shaped strips help to increase the effective dielectric of the background material and reduce the size of the $\lambda/4$ sections. Furthermore, a three-dimensional EBG structure is designed to produce an isotropic band-gap medium independent of the wave incidence angle and polarization state.

Finally, the embedded-circuit meta-material with a modified topology is used to obtain a dispersive bi-anisotropic material. It is shown that the bi-anisotropic medium demonstrates a band-gap behavior over a frequency range where both $\epsilon_{eff}$ and $\mu_{eff}$ are negative. The proposed methodology and the meta-materials presented in the present invention open new doors for the design of novel antennas and RF circuits, which were not possible before.

The present invention can be summarized as follows:

(1) characterization of complex periodic structures of wire loops embedded in dielectric materials; (a) transmission line model to briefly obtain an in-depth study of the periodic structure; and/or (b) FDTD numerical technique to comprehensively characterize the interactions of electromagnetic waves within the composite medium;

(2) Electro-Ferromagnetic Medium; (a) novel wire loop composite medium with tunable permittivity and permeability properties; (b) transmission line and FDTD approaches to successfully characterize the structure; (c) using co-planar strips to generate $\epsilon$ property and wire loops to produce $\mu$ property; (d) accurate representation of the effective permittivity and permeability, and the loss tangent; (e) electronically tunable constitutive parameters around the frequency of interest using an applied DC voltage and tunable (B ST); and/or (f) compactness and affordability;

(3) Electromagnetic Band-Gap Structure; (a) unique wire loop tunable band-gap medium; (b) concept of stop-band behavior using the circuit model approach; (c) FDTD to detail the performance of structure; (d) proper combinations of parallel and series LC circuits in controlling the band-gap behavior; (e) tunable band-gap applying a DC voltage; (f) compact size with enhanced bandwidth; and/or (g) 3-D wire loop composite to generate a complete band-gap for arbitrary incident plane wave; and/or (4) Bi-Anisotropic Material; (a) wire loop bi-anisotropic medium; (b) transmission line model to clarify the concept of bi-anisotropic behavior; and/or (c) FDTD technique to accurately characterize the complex structure and obtain both amplitude and phase of the transmitted wave through the medium.

BRIEF DESCRIPTION OF THE DRAWINGS

The description herein makes reference to the accompanying drawings wherein like reference numerals refer to like parts throughout the several views, and wherein:

FIG. 12A shows details of the embedded-circuit medium, and FIG. 12B shows the behavior of $\epsilon_{eff}$-$\mu_{eff}$ with changes in frequency;

FIG. 14A shows details of the dissimilar embedded-circuit medium including different loop capacitors of the odd and even layers; and FIG. 14B shows the behavior of $\epsilon_{eff}$-$\mu_{eff}$ with changes in frequency;

FIGS. 15A–15B illustrate, respectively, the magnitude and the phase spectral behaviors of the transmission coefficient of the double resonance permeability meta-material of FIGS. 14A–14B calculated using FDTD and analytical formulations;

FIG. 16 illustrates a one-dimensional stop-band miniaturized EBG formed by a three-resonant embedded-circuit meta-material;

FIG. 17A shows the $\lambda/4$ impedance inverter; and FIG. 17B shows the equivalent circuit after $\lambda/4$ transformation;

FIG. 19 illustrates a 3-D miniaturized embedded-circuit meta-material EBG and one of the building blocks of the material;

FIG. 20 illustrates the spectral behavior of the transmission coefficient of the normal and oblique incidence plane waves through the 3-D EBG shown in FIG. 19 and also shows the same response for the 1-D EBG shown in FIG. 16 at oblique incidence, which does not show the band-gap behavior;

DESCRIPTION OF THE PREFERRED EMBODIMENT

Embedded-Circuit Meta-Materials

In this section the main concept of embedded-circuit meta-materials is introduced and an analytical approach for characterizing their macroscopic material property is presented. The analytical technique is based on a transmission line method that account for mutual interaction of all embedded-circuits. The FDTD numerical technique is also applied to validate the results.

Transmission Line Method

The simplest form of electromagnetic waves in a homogeneous and source free region is a transverse electromagnetic (TEM) plane wave. Basically a plane wave is an eigenfunction of the wave equation whose corresponding eigenvalue, the propagation constant $\kappa$, is a function of the medium constitutive parameters. The interest in studying the behavior of plane waves in a medium stems from the fact that any arbitrary wave function can be expressed in terms of a superposition of these fundamental wave functions. For a simple medium, the permittivity and permeability are scalar and constant functions of position (isotropic and homogeneous), which can support ordinary TEM plane waves.

Figure 1A:
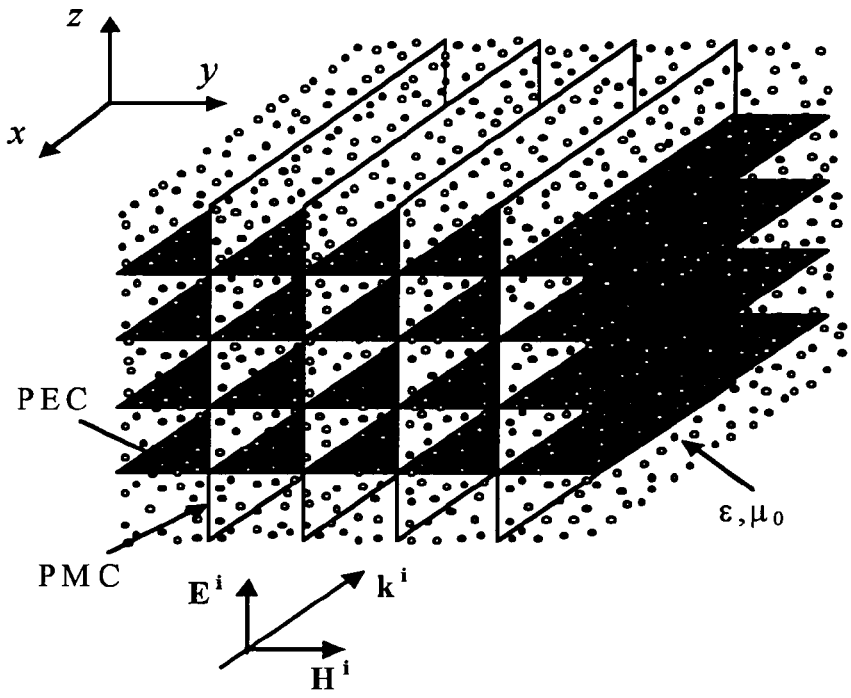
FIGS. 1A–1C illustrate a dielectric material supporting a TEM plane wave, where in FIG. 1A the medium is visualized in terms of wave cells made up of a periodic structure of parallel PEC and PMC surfaces orthogonal to each other, in FIG. 1B a building block wave-cell is shown, and in FIG. 1C an equivalent circuit model is shown.
Figure 1B:
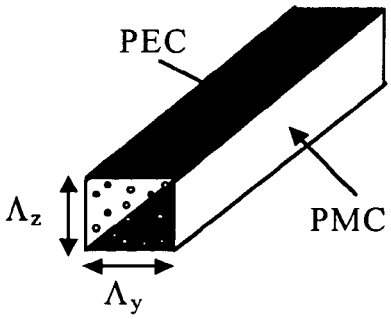
Figure 1C:
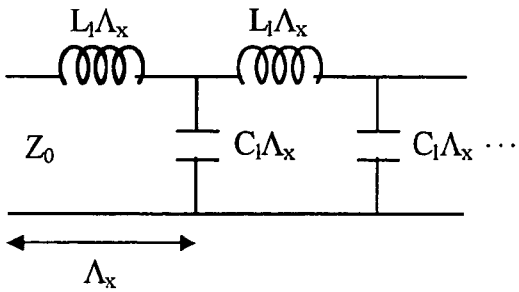

It is customary to view a medium supporting a propagating plane wave by a transmission line carrying a TEM wave having the same characteristic impedance and propagation constant as those of the medium. Equivalently the line inductance ($L_1$) and capacitance ($C_1$) per unit length are the same as the permittivity ($\epsilon_o$) and permeability ($\mu_0$) of the medium. Basically, each small cell of the medium can be viewed as a mesh of parallel Perfect Electric Conductor (PEC) planes perpendicular to the electric field $E^i$ and parallel Perfect Magnetic Conductor (PMC) planes perpendicular to the magnetic field $H^i$ as shown in FIG. 1A. The field behaviors in all wave-cells are identical; hence studying one cell, such as that shown in FIG. 1B reveals the wave characteristics of the incident field. FIG. 1C shows an equivalent circuit of a wave-cell of FIG. 1B where $L_y$ and $L_z$ are the cell dimensions in the y and z directions.

Figure 2A:
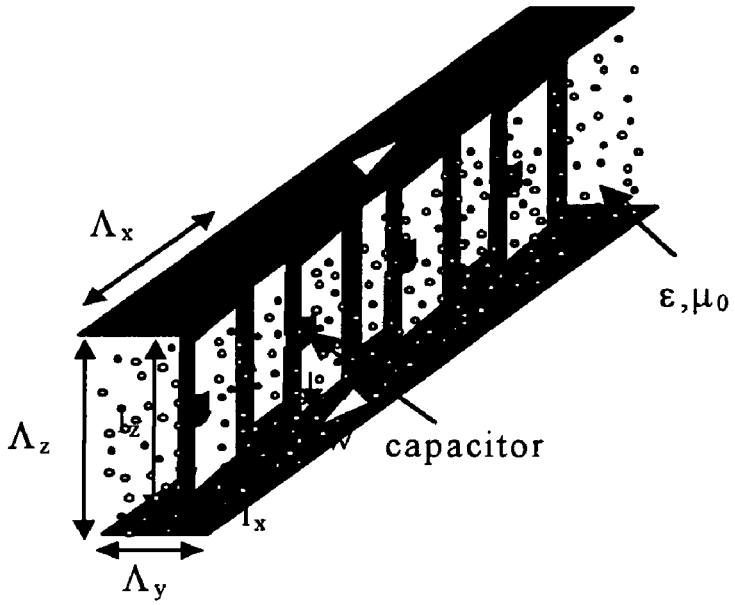
FIGS. 2A–2B illustrates in FIG. 2A a transmission line periodically loaded with metallic loops loaded with respective capacitors, and in FIG. 2B the equivalent circuit of a segment of the transmission line model of FIG. 2A.
Figure 2B:
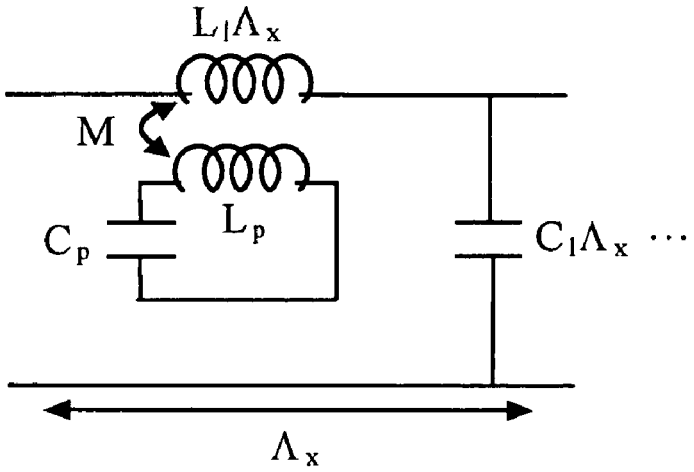

Now consider a modification to the equivalent transmission line model by inserting a thin wire loop having a self-inductance of $L_p$ terminated by a lumped capacitor having a capacitance of $C_p$ as shown in FIG. 2A. The magnetic flux linking the transmission line induces a current in the loop in a direction so that the magnetic flux generated by the loop opposes the transmission line magnetic flux. The arrows shown in FIG. 2A illustrate the current distribution in each of the transmission line and the loop, which has dimensions in the x and y directions of $l_x$ and $l_y$, respectively. As in FIG. 1, $L_y$ and $L_z$ are the cell dimensions in the y and z directions. The cell dimension in the x direction is $L_x$, as shown in both FIGS. 2A and 2B. FIG. 2B shows the equivalent circuit of the resonant circuit and the short transmission line segment. The mutual coupling between the loop and the transmission line inductance are denoted by mutual inductance M. Loading the transmission line in a periodic fashion with identical resonant circuits creates a new transmission line with modified inductance per unit length, and the resonant characteristics of the loop circuit generate the $\mu$ property.

Figure 3:
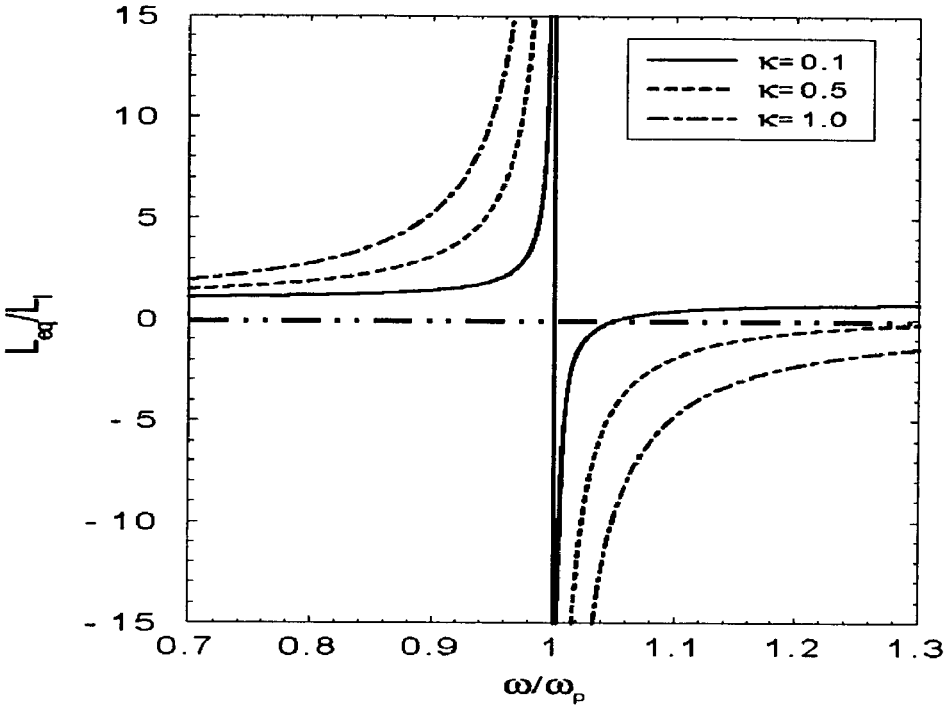
FIG. 3 illustrates a spectral behavior of equivalent inductance of the periodically loaded transmission line of FIGS. 2A–2B for different coupling coefficients $\kappa$.

The telegrapher's equations for the transmission line segment shown in FIG. 2B can easily be derived. These equations are then used to obtain the equivalent inductance per unit length of the periodically loaded transmission line, which is found to be $$L_{eq} = L_1\left[1 - \kappa^2 \frac{1}{1 - \omega_p^2/\omega^2}\right] \tag{1}$$

where $\omega_p = 1/\sqrt{L_p C_p}$ is the resonant frequency of the loop referred to as the "plasma frequency" because of resemblance of equation (1) to the expression for the permittivity of plasma, and $\omega$ is the frequency of the incident wave. The coupling coefficient is $\kappa$, where $\kappa = M/\sqrt{(L_l L_x) L_p}$. Below the resonant frequency, the equivalent inductance per unit length $L_{eq}$ is higher than the original line inductance $L_l$ (the higher effective permeability), and as the frequency $\omega$ approaches the resonant frequency $\omega_p$, the equivalent line inductance $L_{eq}$ approaches infinity as illustrated in FIG. 3. Near resonance and at frequencies where $\omega < \omega_p$, the line becomes a slow-wave structure.

It is also interesting to note that in situations where $\omega$ is slightly larger than $\omega_p$ the equivalent inductance becomes negative as also shown in FIG. 3. In the frequency region where $L_{eq}$ is less that zero, the propagation constant becomes purely imaginary. Consequently, the line will not support wave propagation. The bandwidth between $\omega_p$ and the frequency $\omega_z$ where $L_{eq}$ is equal to zero is known as the band-gap region. Setting the right-hand-side of equation (1) equal to zero and solving for $\omega_z$, the normalized bandwidth of the band-gap region can be obtained and is given by $$\frac{\Delta\omega}{\omega_p} = \frac{1}{\sqrt{1-\kappa^2}} - 1 \tag{2}$$

where $\Delta\omega$ is the bandwidth, i.e., the change in frequency over the band-gap. It is clear that the bandwidth of the band-gap region is determined by the coupling coefficient ($\kappa$). In practice $M^2<(L_l\Lambda_x)L_p$ or equivalently $\kappa<1$. However, if this ratio can be made close to unity, a rather large band-gap region can be achieved as demonstrated in FIG. 3.

The values of $L_l$, $L_p$ and M characterize the performance of the modified line. These parameters can easily be estimated for the transmission line under consideration shown in FIG. 2B. The magnetic field is a constant value of $\hat{y}H_0$ where $H_0$ is the magnetic field inside the loop. Hence the associated magnetic flux is $\Phi=\mu_0 H_0 \Lambda_x \Lambda_z$, and according to the boundary condition the current on the line is $I=H_0\Lambda_y$. Therefore, the inductance per unit length of the line (segment of length $\Lambda_x$) is found to be $L_l=(1/\Lambda_x)\Phi/I=\mu_0\Lambda_z/\Lambda_y$ as expected. The self-inductance of the loop in the presence of PMC planes can be obtained in an approximate fashion assuming that $\Lambda_y<\Lambda_x\Lambda_z$. Imaging the loop in the PMC walls, an infinite array of closely spaced loops is generated. According to image theory, the electric currents carried by all these loops are identical. This configuration resembles an infinite toroid with $1/\Lambda_y$ turns per meter. The self-inductance of such toroid can be obtained from $$L_p = \frac{\mu_0 A_p}{\Lambda_y} = \frac{\mu_0 l_x l_z}{\Lambda_y} \tag{3}$$

where $A_p=l_x l_z$ is the area of the loop. The mutual inductance can also be calculated easily and is given by $$M = \frac{\mu_0 A_p}{\Lambda_y} \tag{4}$$

As a result, the coupling coefficient is found to be $$\kappa^2 = \frac{M^2}{(L_1\Lambda_x)L_p} = \frac{l_x l_z}{\Lambda_x \Lambda_z} < 1 \tag{5}$$

This result indicates that a larger fractional area occupied by the loop results in a wider band-gap region. Although desirable that the quantity $M^2/(L_l\Lambda_x)L_p<1$ be close to one, due to the finiteness of the line widths and the capacitor dimensions, it cannot be made arbitrarily close to unity.

Thus, using a reverse process the equivalent, or effective, permeability $\mu_{eff}$ of an embedded resonant circuit metamaterial in a homogeneous dielectric background, by example an RT/Duroid substrate, can be obtained from the first equation (1) and is given by $$\mu_{eff} = \mu_0\left[1 - \kappa^2 \frac{1}{1-\omega_p^2/\omega^2}\right] \tag{6}$$

where the homogeneous dielectric background has an intrinsic permittivity and permeability of $\epsilon$ and $\mu_0$, respectively. This structure, shown in FIG. 4, macroscopically presents an effective permittivity ($\epsilon_{eff}$) and permeability ($\mu_{eff}$).

Calculation of Magnetic Loss Tangent

Figure 5:
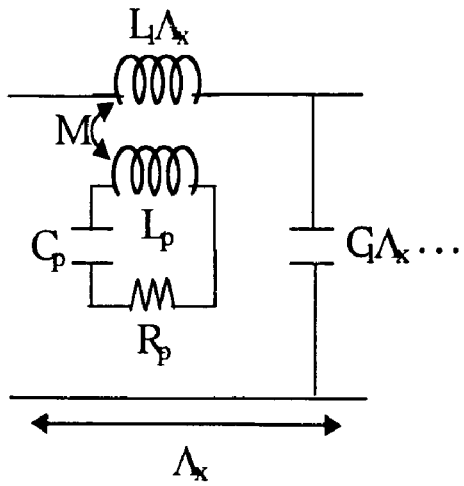
FIG. 5 illustrates a modified equivalent circuit model of the embedded-circuit transmission line of FIGS. 2A–2B that accounts for the ohmic loss of the metallic loop.
Figure 6A:
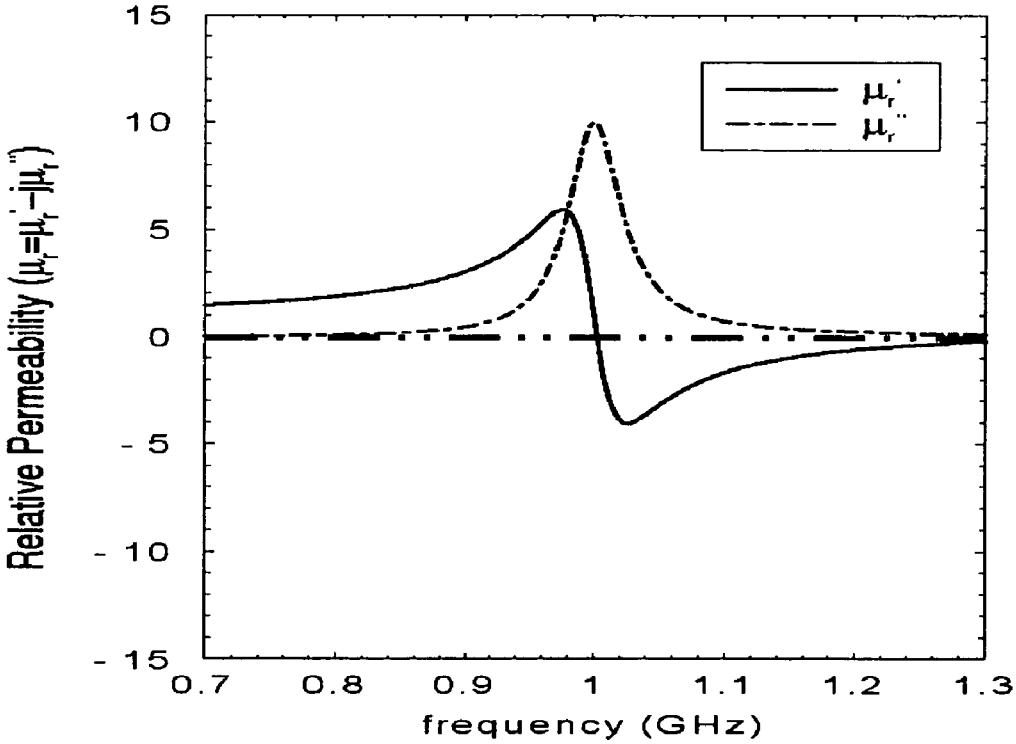
FIGS. 6A–6D illustrates the complex effective permeability of the embedded-circuit medium for different values of the circuit quality factor according to the seventh equation (7)
Figure 6B:
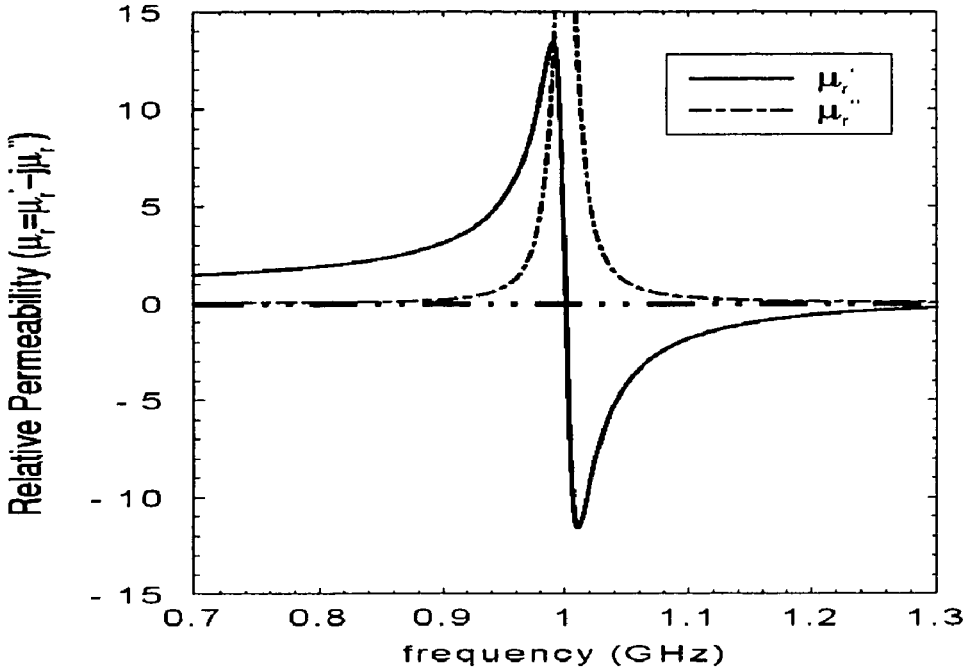
Figure 6C:
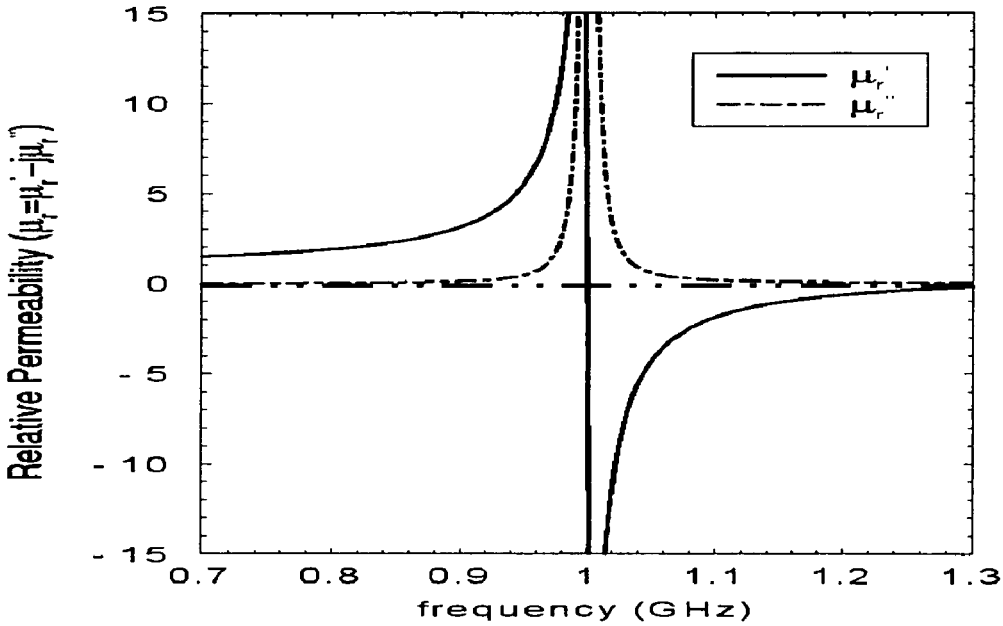
Figure 6D:
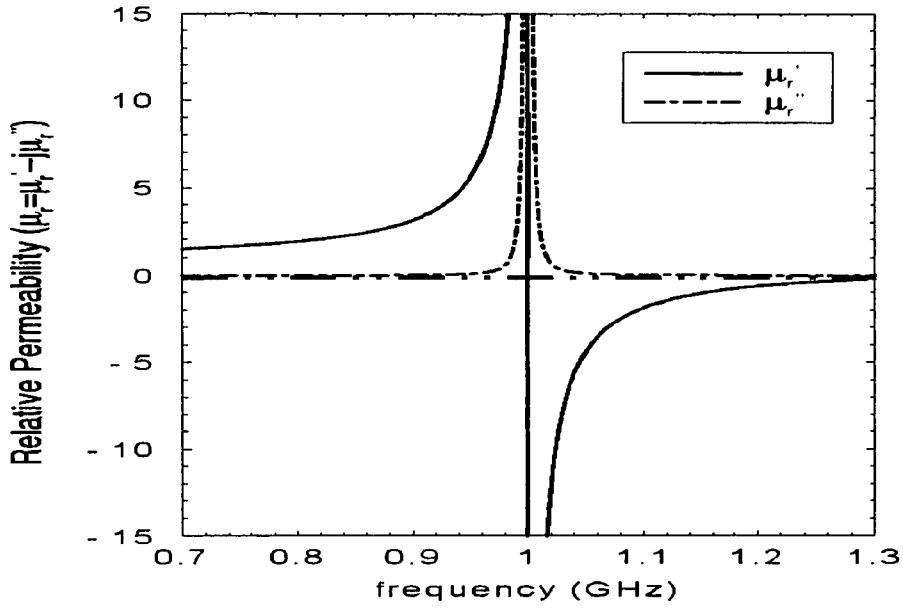
Figure 7:
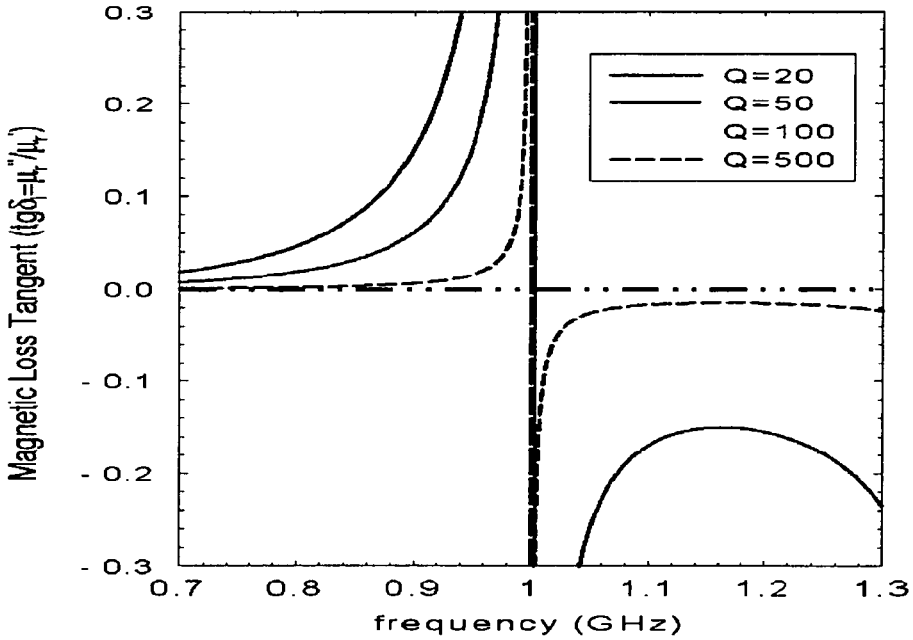
FIG. 7 illustrates the magnetic loss tangent of the embedded-circuit medium for different values of the circuit quality factor.

The metallic wires, or loops, of the embedded-circuits have some finite conductivity, which result in some Ohmic resistance. This effect must be accounted for in the calculation of the effective medium parameters. The equivalent circuit model shown in FIG. 2B can be simply modified by inserting a series resistance $R_p$ into the loop as shown in FIG. 5. Using simple circuit analysis, the modified effective inductance per unit length or equivalently the effective permeability of the medium can be obtained. In this case the effective permeability becomes complex and is given by $$\mu_{eff} = \mu_0\left[1 - \kappa^2 \frac{1}{1-\omega_p^2/\omega^2 - j/Q}\right] \tag{7}$$

where $Q=\omega L_p/R_p$ is the quality factor of an isolated resonator loop. FIGS. 6A–6D show the spectral representation of $\mu_{eff}/\mu_0$ for a number of Q values and a coupling coefficient $\kappa=0.5$. One issue of practical importance is the lowest achievable magnetic loss tangent ($\mu''/\mu'$), which is related to the Q of the circuit. The variation of the magnetic loss tangent for different values of Q is presented in FIG. 7.

Assuming that the loop is made up of a metal strip with conductivity $\sigma$ and has a thickness of $\tau>2\delta$, where $\delta=\sqrt{2/\omega\mu_0\sigma}$ is the skin depth of the metal at the operating frequency, the Q can be calculated from:

$$Q = \frac{4 l_x l_z w}{\Lambda_y (l_x + l_z)\delta} \tag{8}$$

where w is the width of the metal strip. This equation indicates that at frequencies up to about 2 GHz, Q values of about 300 to 400 can be easily achieved. At frequencies of up to about 3 GHz, Q values of about 200 to 300 can be achieved. As the frequency increases, the parameters $l_x$, $l_z$ and $\Lambda_y$ must be scaled with frequency. However, the width (w) of the strip can be kept constant up to a point beyond which it must also be scaled down with increasing frequency. Hence, at lower frequencies (while w is kept constant) Q increases with frequency as $\sqrt{f}$, but at high frequencies, where w is also scaled down, the Q decreases with frequency as $1/\sqrt{f}$. In this and in other examples herein, the metal loop can be any metal, such as copper.

Coupling Capacitance and Effective Dielectric Constant

Figure 8:
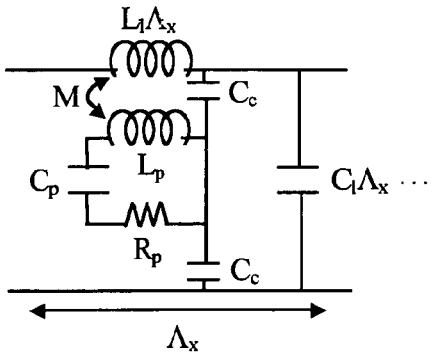
FIG. 8 illustrates complete equivalent circuit model of the embedded-circuit transmission line of FIGS. 2A–2B, including both the ohmic loss and the parasitic capacitances that exist between the wires and the transmission line.

In the equivalent transmission line model shown in FIG. 2B, certain parasitic elements were ignored for the sake of simplicity. However, as will be shown next, these can have a significant effect on the effective, permittivity of the medium. There exist coupling capacitances between the wires of the loop and the conductors of the transmission line in the equivalent circuit model. Denoting the capacitance of these coupling capacitors by $C_c$, a complete equivalent circuit model can be obtained and is shown in FIG. 8. In reality these coupling capacitors account for the electric coupling among the infinite stack of wire loops in the medium with a background permittivity $\epsilon$. It is apparent that the coupling capacitors do not interact with the current in the loop comprising Lp, Cp and Rp, and therefore, do not affect the equivalent permeability.

Figure 9:
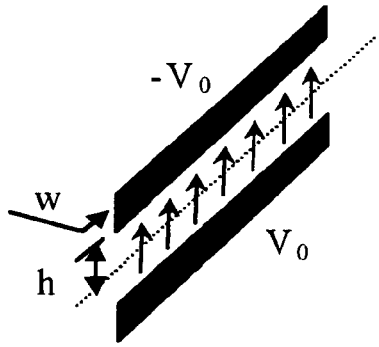
FIG. 9 illustrates co-planer strips having a capacitance per unit length $C_s$ evaluated using the tenth equation (10)

A glance at the equivalent circuit depicted in FIG. 8 shows that the equivalent capacitance per unit length of the line segment is given by $$C_{eq} = C_l + \frac{C_c}{2\Lambda_x} \tag{9}$$

where $C_l=\epsilon\Lambda_y/\Lambda_z$. An approximate expression for $C_c$ can be obtained by noting that the coupling capacitor is formed by a vertical strip of width w and length $l_x$ at a height h above a perfect conductor. An analytical formulation for the capacitance per unit length of two thin co-planar strips ($C_s$) such as those shown in FIG. 9 already exists. The capacitance between a thin strip and a perfect conductor is simply twice that of the two co-planar strips. Using the conformal mapping technique, $C_s$ is shown to be $$C_s = \frac{\varepsilon K(\sqrt{1-g^2})}{K(g)} \tag{10}$$

where g=h/(h+w), and K is the complete elliptic integral defined by $$K(g) = \int_0^{\pi/2} \frac{d\phi}{\sqrt{1-g^2\sin^2\phi}} = \frac{\pi}{2}\left[1+\left(\frac{1}{2}g^2\right)^1+\left(\frac{1\cdot 3}{2\cdot 4}g^2\right)^2+\left(\frac{1\cdot 3\cdot 5}{2\cdot 4\cdot 6}g^2\right)^3+\ldots\right] \tag{11}$$

where ø is the integrand variable. Hence, the coupling capacitance can easily be calculated from $C_c=2C_sl_x$. It is also worth mentioning that despite a relatively large surface area, electric coupling between adjacent loops cannot take place because of the existence of virtual magnetic walls between the loops as shown in FIGS. 1A and 1B.

In view of the above discussion, the effective permittivity of the medium can be then calculated from $$\varepsilon_{eff} = \varepsilon\left[1+\frac{\Lambda_z l_x}{\Lambda_x\Lambda_y}\frac{K(\sqrt{1-g^2})}{K(g)}\right] \tag{12}$$

Figure 4:
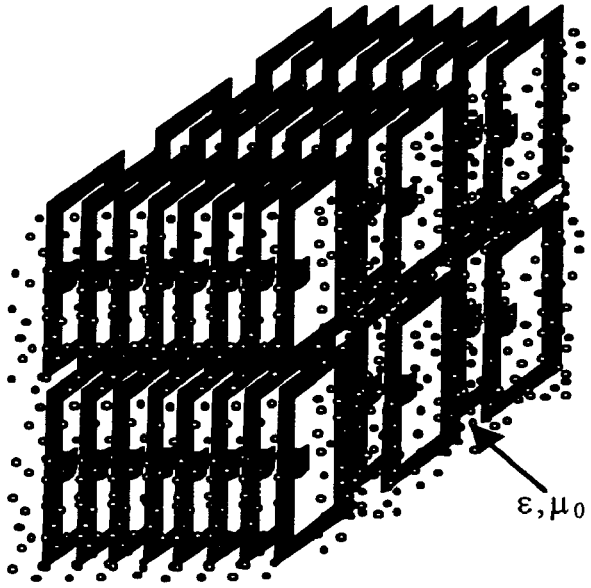
FIG. 4 illustrates periodically embedded resonant circuits in a homogeneous background medium.

Therefore, the designed embedded-circuit meta-material shown in FIG. 4 can be simply viewed as a homogeneous anisotropic medium with an effective permittivity tensor having $\epsilon_z=\epsilon_{eff}$, $\epsilon_x=\epsilon_y=\epsilon_0$ (the intrinsic permittivity of the non-magnetic, dielectric medium), and effective permeability tensor having $\mu_y=\mu_{eff}$, $\mu_x=\mu_z=\mu_0$ (the intrinsic permeability of the non-magnetic, dielectric medium).

Electro-Ferromagnetism

As demonstrated, a simple non-magnetic medium loaded with electrically small resonant LC circuits in a periodic fashion behaves as a dispersive magnetic medium whose effective permeability is a function of frequency and takes on both positive and negative values. In the frequency region where $\mu_{eff}>\mu_0$ the medium becomes magnetic, and where $\mu_{eff}<0$ the medium becomes band-gap. The value of $\mu_{eff}$ at a particular frequency depends on the resonant frequency of the embedded loops. If the resonant frequency is changed, say by varying the loop capacitance $C_p$, both the equivalent permeability of the medium as well as its band-gap region can be varied. Of course changing $C_p$ mechanically is not easy, nor is it desirable. The application of electronic tunable capacitors seems to be an appropriate choice to make the medium electronically tunable.

Diode and ferro-electric varactors can be employed for this application. Thin films of Barium-Strontium-Titanate ($Ba_xSr_{1-x}TiO_3$), BST, possesses a high dielectric constant and ferro-electric properties. This compound, when used as a thin film in a capacitor (either in parallel plate or interdigitated configurations), produces an electrically small varactor with a relatively high tunability (>50%) and high Q (~100 @2 GHz), while requiring a relatively low tuning voltage. Similarly diode varactors show relatively high Q and tunability. However, BST may be easier to grow directly on the substrate layers. Another advantage of BST varactors is that they do not require a reverse bias, and therefore complicated bias lines in an already complex circuit can be eliminated.

Figure 10:
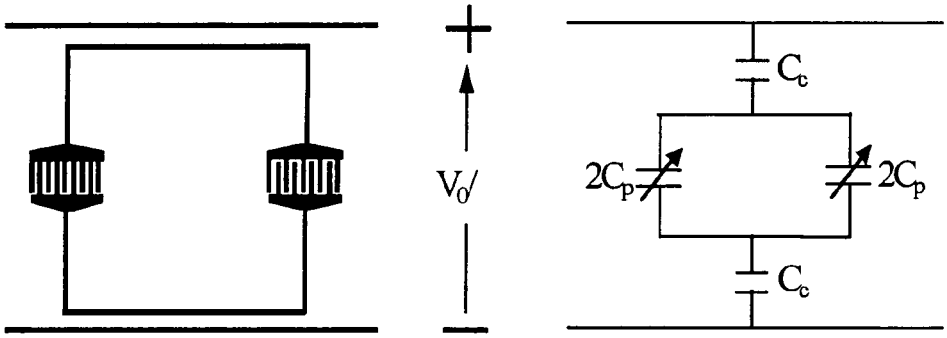
FIG. 10 illustrates a wire loop with two BST varactors in a transmission line and its corresponding low frequency circuit model.

The BST varactors in each loop can simply be tuned by establishing a DC electric field in the medium. In order to tune BST varactors by an applied electric field and design an electro-ferromagnetic or tunable band-gap material, the embedded-circuit needs to be modified slightly. At DC, the loop varactor $C_p$ is short-circuited so the applied DC electric field will not be able to change the capacitance. However, if two series capacitors are placed one on each side of the loop as shown in FIG. 10, this problem can be circumvented. Basically two varactors each having a nominal capacitance $2C_p$, can be placed in the loop without changing the effective medium parameters.

As an example, consider a slab of the electro-ferromagnetic material confined between two parallel plates with a DC potential difference $V_0$. If there are N vertical loop layers between the plates, a voltage drop of $V_0/N$ is experienced across a single layer. Referring to FIG. 10, it is now apparent that the tuning voltage across the varactors is simply given by $$V_t = \frac{C_c}{C_c+2C_p}\cdot\frac{V_0}{N}. \tag{13}$$

Of course both capacitors in the loop do not have to be varactors. One may be a fixed capacitor and the other a varactor. However, a scheme incorporating one fixed capacitor will demonstrate a lower tunability as a function of the applied voltage.

In practice, manufacturing of electro-ferromagnetic (tunable band-gap) embedded-circuit meta-material can be simply performed using a stack of periodically printed circuits on a low-loss dielectric material. The loop capacitor can also be printed on the substrate, using simple gaps or interdigitated lines depending on the required values of capacitance.

FDTD Full Wave Analysis

Figure 11:
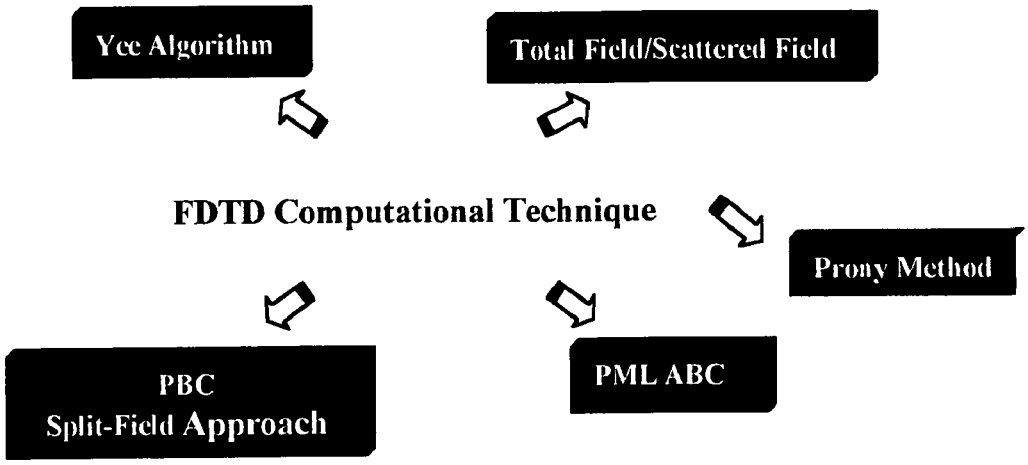
FIG. 11 illustrates a schematic of the FDTD/Prony computational tool.

In order to verify the analytical results and have a powerful computational engine for characterizing complex structures, an efficient and advanced numerical method based on the Finite Difference Time Domain (FDTD) technique with Periodic Boundary Conditions/Perfectly Matched Layer (PBC/PML) is employed in this work. Additionally, the Prony extrapolation scheme is integrated to expedite the computational time. The FDTD numerical code allows for determining the behavior of electromagnetic waves in finite or periodic 3-D complex media composed of an arbitrary arrangement of dielectric, magnetic, and metallic structures. An advantage of FDTD method is that it provides the frequency response of the structure of interest at once. The main features of the FDTD engine used in this analysis are shown in FIG. 11. Further details of the FDTD technique can be had by reference to N. Engheta and P. Pelet, "Reduction of surface waves in chirostrip antennas," *Electronics Lett.*, vol. 27, no. 1, pp. 5–7 (January 1991); P. Pelet and N. Engheta, "Chirostrip antennas: line source problem," *J. Electro. Waves Applic.*, vol. 6, no. 5/6, pp. 771–794 (1992); P. Pelet and N. Engheta, "Novel rotational characteristics of radiation patterns of chirostrip dipole antennas," *Microwave and Opt. Tech. Lett.*, vol. 5, no. 1, pp. 31–34 (January 1992); and P. Pelet and N. Engheta, "Mutual coupling in finite-length thin wire chirostrip antennas," *Microwave and Opt. Tech. Lett.*, vol. 6, no. 9, pp. 671–675 (September 1993), which are each incorporated herein by reference.

Performance Characterization of Embedded-Circuit Meta-Materials

In this section prototype embedded-circuit meta-materials are considered and the accuracy of the analytical formulation is examined against the full wave FDTD solution.

Figure 12A:
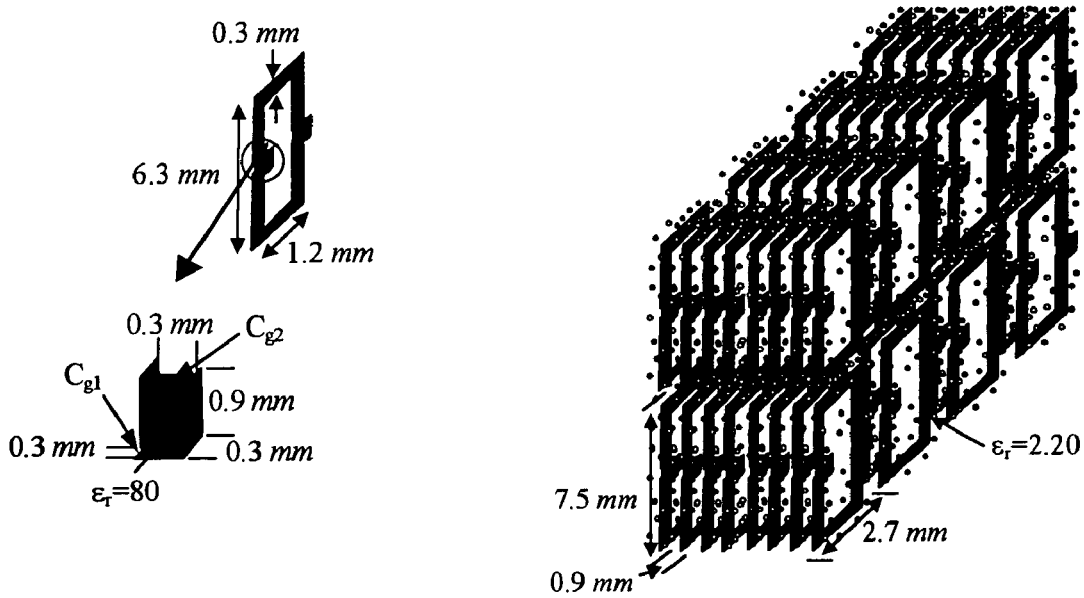
FIGS. 12A–12B illustrate a single resonance permeability meta-material, where
Figure 12B:
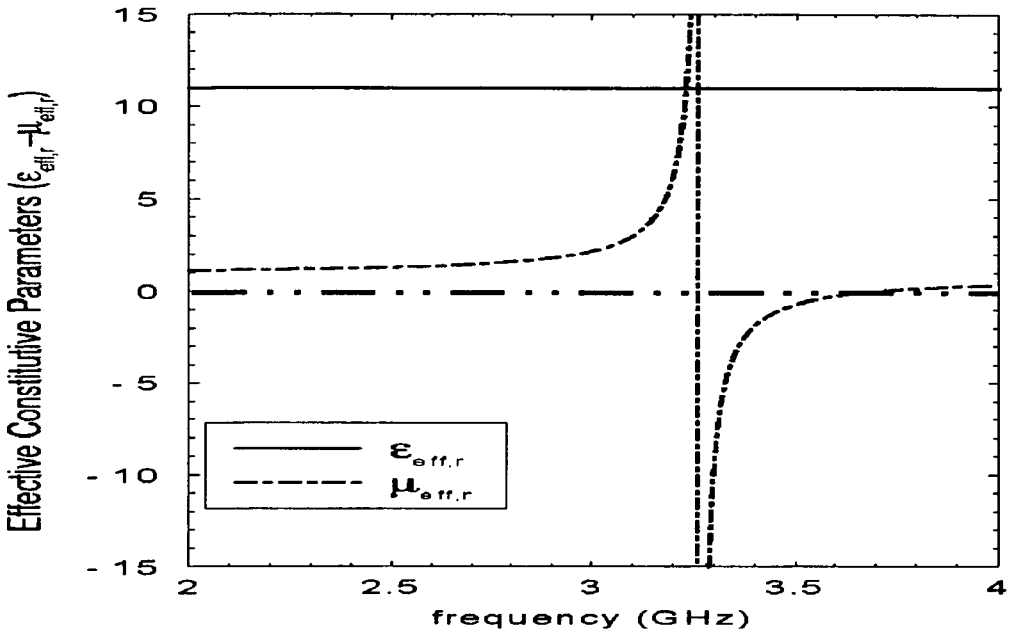

The geometry of a periodic resonant circuit embedded in a low loss dielectric material with $\epsilon_r$=2.2 is depicted in FIG. 12A and FIG. 12B. The dimensions of the loop and the capacitors depend upon the design frequency and are shown here and elsewhere for illustrative purposes only. As discussed before, this medium exhibits the effective permittivity and permeability parameters ($\epsilon_{eff}$, $\mu_{eff}$), whose values can be determined from equation (12) and equation (6). In this example the conductive losses of the metallic strips are ignored. From equation (12) and assuming g=⅔, the relative effective permittivity $\epsilon_{eff,r}$ of the medium is found to be equal to 10.89, which is 4.95 times that of the background material ($\epsilon_r$=2.2). This example indicates that the embedded resonant circuits can drastically increase the effective permittivity as well.

To obtain the effective permeability, the loop resonant frequency $\omega_p$ and coupling coefficient κ are evaluated. The self-inductance $L_p$ of the loop is found from equation (3) to be $L_p$=9.05 nH. The gap capacitance $C_g$, as shown in FIG. 12A, can be considered as effective capacitance of two parallel capacitors $C_{g1}$ (capacitance for co-planar strips with relative average dielectric $\epsilon_{av,r}$=(80+2.2)/2) and $C_{g2}$ (capacitance for parallel plates with relative dielectric $\epsilon_{d,r}$=80). The values for $C_{g1}$ (including the edge effects of small strips) and $C_{g2}$ are estimated around 0.10 PF and 0.43 PF, respectively. The loop capacitance $C_p=(C_{g1}+C_{g2})/2$ is found to be 0.265 PF. The values of $L_p$ and $C_p$ give $\omega_p=1/\sqrt{L_pC_p}=2.04\times10^{10}$ rad/s. The coupling coefficient κ between the transmission line and effective area of the loop is evaluated from equation (5) and is equal to 0.49. The spectral behavior of $\epsilon_{eff,r}$ and $\mu_{eff,r}$ of this medium is shown in FIG. 12B.

Figure 13A:
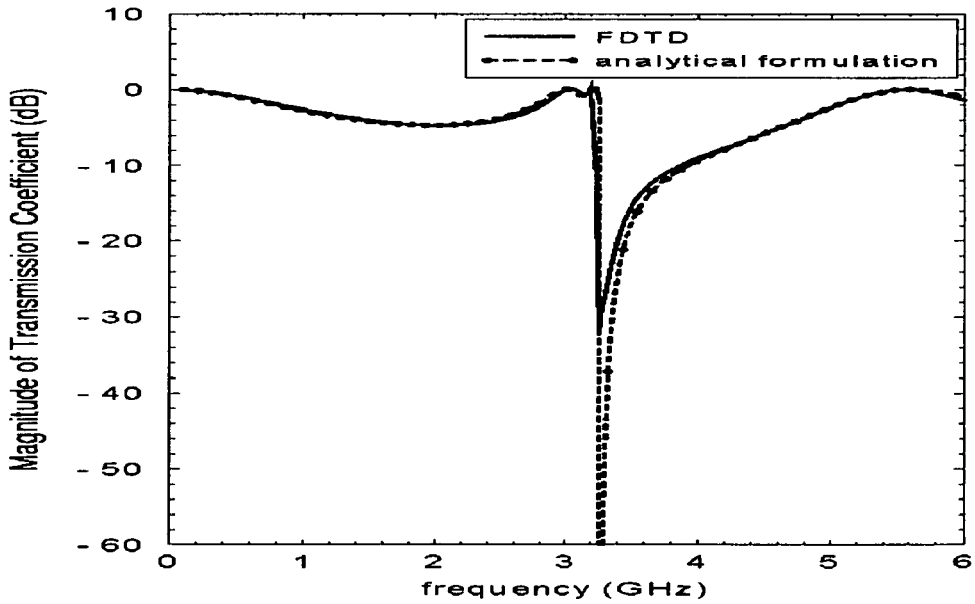
FIGS. 13A–13B illustrate, respectively, the magnitude and the phase spectral behaviors of the transmission coefficient of the single resonance permeability meta-material of FIGS. 12A–12B calculated using FDTD and analytical formulations.
Figure 13B:
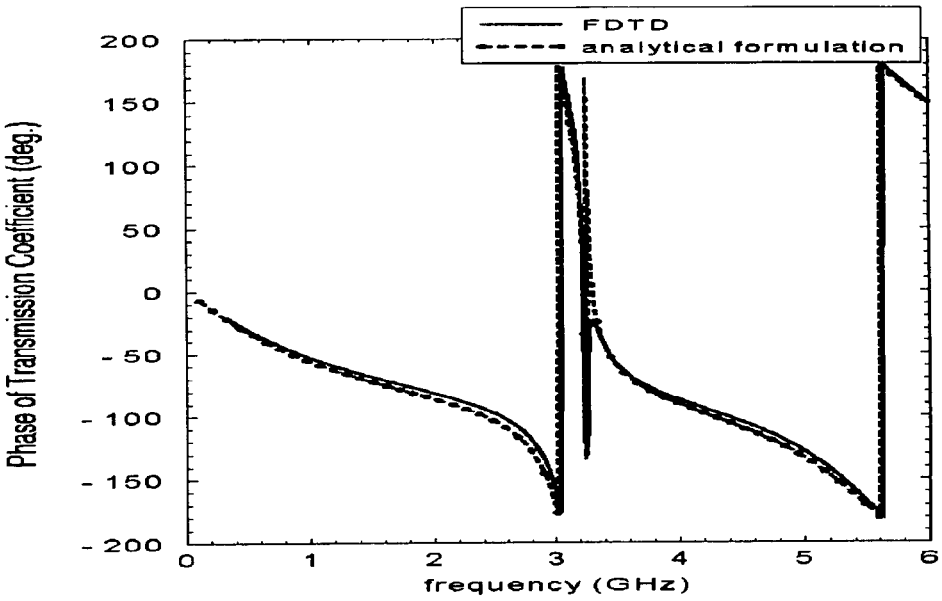

To examine the accuracy of the analytical formulation, the FDTD full wave analysis with PBC/PML boundary conditions is applied to investigate the transmission coefficient of a normal incident plane wave through a slab of the embedded-circuit medium. FIGS. 13A and 13B compare the transmission coefficient calculated using FDTD for the embedded-circuit periodic medium and that of a homogeneous magneto-dielectric slab with thickness t=9.9 mm, relative effective permittivity $\epsilon_{eff,r}$=10.89, and relative effective permeability $\mu_{eff,r}$ where $$\mu_{eff,r} = 1 - \frac{(0.49)^2}{1-(3.25/f(\text{GHz}))^2}. \tag{14}$$

Considering the approximation nature of estimated value of $C_p$ and numerical error, an excellent agreement between the analytical formulation and FDTD result is demonstrated. The transmission null is a clear indication of band-gap property of the meta-material.

Figure 14A:
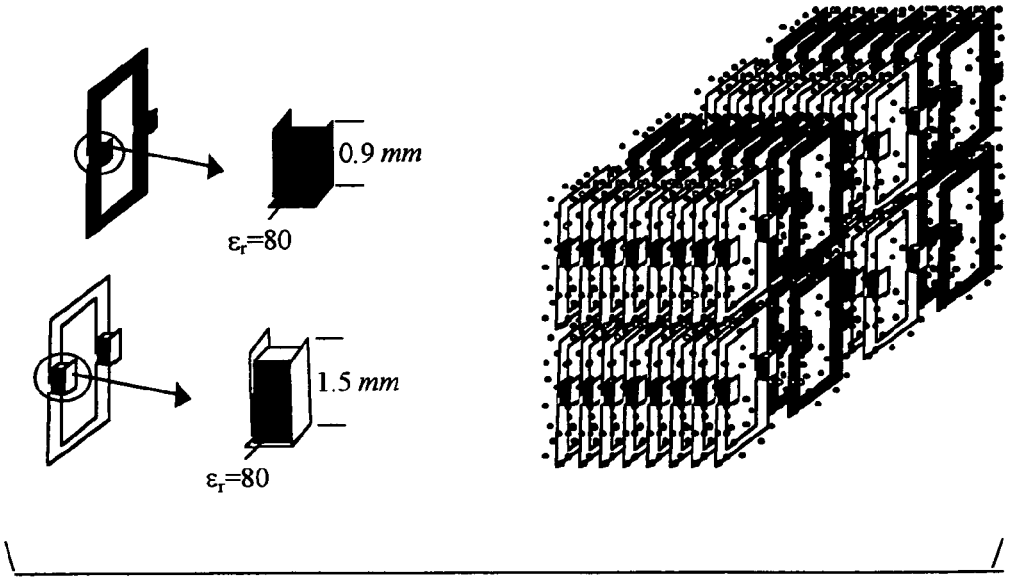
FIGS. 14A–14B illustrate a double resonant permeability meta-material, where
Figure 14B:
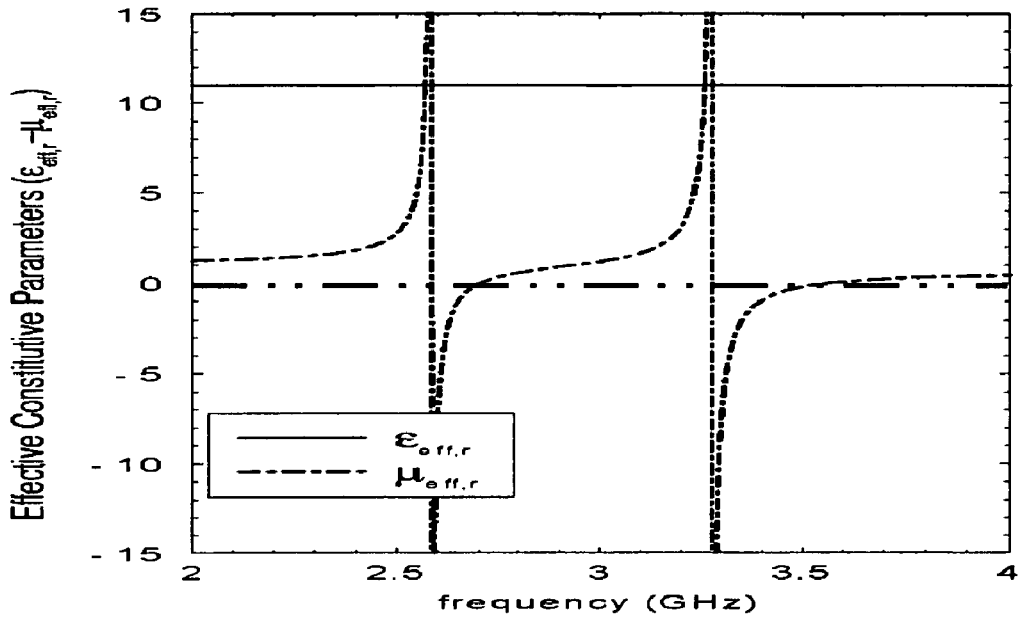
Figure 15A:
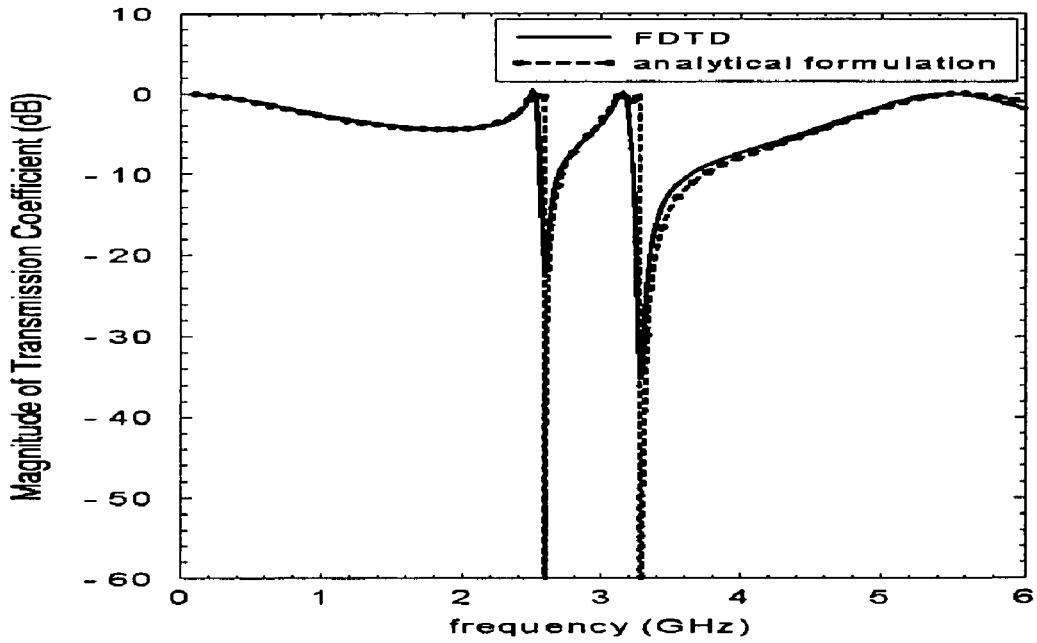

The present invention of embedded-circuit meta-material can be extended to include dissimilar circuits. For example, FIG. 14A shows a periodic embedded-circuit medium where the odd and even layers have different loop capacitors. Since each circuit has a different resonant frequency, the effective permeability of the medium has two distinct poles. It can easily be shown that a zero always exists between these two poles. Since the loops are located in the same plane the mutual coupling between the loops can be ignored. The relative effective permeability for the medium is simply given by $$\mu_{eff,r} = 1 - \frac{1}{2}\left[\frac{(0.49)^2}{1-(2.58/f(\text{GHz}))^2} + \frac{(0.49)^2}{1-(3.25/f(\text{GHz}))^2}\right], \tag{15}$$

and it is plotted in FIG. 14B. The transmission coefficient calculated by the FDTD for the embedded-circuit material and that obtained for the equivalent slab are shown in FIGS. 15A and 15B and illustrate the excellent agreement between the results. To obtain an isotropic embedded-circuit meta-material, a three-dimensional (3-D) structure, such as that shown in FIG. 19, can be created. FIG. 19 is discussed in more detail hereinafter.

Tunable Miniaturized EBG Meta-Material with Wide Bandwidth

Electromagnetic Band-Gap (EBG) materials have a wide range of applications in RF and microwave engineering including microwave and optical cavities, filters, waveguides, and smart artificial surfaces, etc. Traditionally, band-gap behavior is achieved using periodic structure with spacing values larger or comparable with the wavelength. Three challenging aspects in the design of EBG structures are (a) miniaturization, (b) electronic tunability, and (c) band-gap width control.

As demonstrated in the previous section, the periodic resonant circuit meta-material presents a band-gap property, whose frequency response can be controlled by the loop capacitor. That is, the electronic tunability can easily be achieved using varactors. Since the dimensions of the embedded resonant circuits are much smaller than the wavelength, the miniaturization requirement is inherently satisfied. In order to increase the bandwidth of the band-gap region a multi-resonant architecture is proposed. However, as pointed out in the previous section, cascaded resonant circuits always demonstrate a zero between the poles of $\mu_{eff}$, disrupting the merger of the two poles for achieving a wider band-gap. To circumvent this difficulty, the concept of impedance inverters from filter theory is borrowed.

FIG. 16 shows a novel band-gap material with a building block composed of three cascaded resonant circuits having gap capacitors $C_{g1}$, $C_{g2}$, $C_{g3}$, in a dielectric material with $\epsilon_r$=2.2. The resonant frequencies of the circuits are denoted by $f_1$, $f_2$, and $f_3$. To remove the zero between the poles, the loops are positioned a quarter wavelength apart from each other. Quarter-wave separation in a medium with $\epsilon_r$=2.2 increases the dimension of the band-gap meta-material. To rectify this problem, I-shaped metallic strips are printed and placed between the resonant circuits. Basically, the I-shaped metallic strips are introduced to increase the effective permittivity of the medium between the resonant circuits and thereby reduce the physical size of the $\lambda/4$ sections.

Figure 17A:
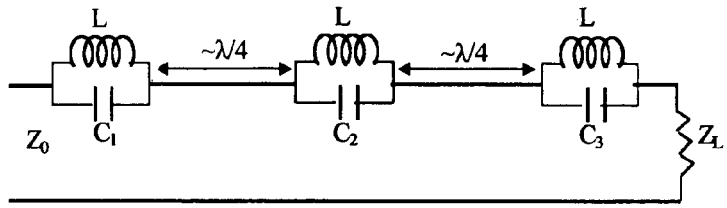
FIGS. 17A–17B illustrate an equivalent circuit model for the EBG shown in FIG. 16, where
Figure 17B:
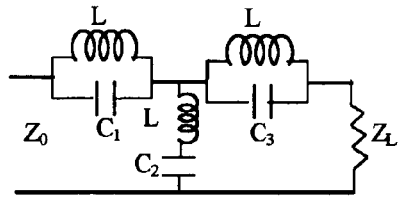

The equivalent circuit model of the composite band-gap structure is illustrated in FIG. 17A. The $\lambda/4$ impedance inverter transforms the series resonant circuit in the middle into an equivalent shunt resonant circuit as shown in FIG. 17B. Choosing $f_1<f_2<f_3$ and merging the three poles by the $\lambda/4$ impedance inverters achieves a wide band-gap.

Figure 18:
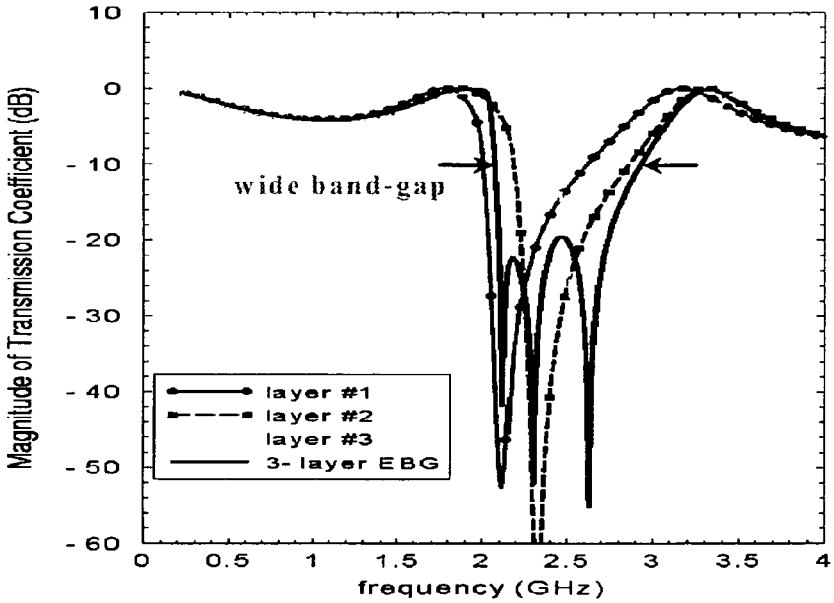
FIG. 18 illustrates the magnitude spectral behavior of the transmission coefficient of the normal incidence plane wave through each of three individual resonant circuits and a composite 3-layer EBG resonant medium.

The FDTD is applied to characterize the behavior of the three-resonant circuit meta-material. The transmission coefficients of a normal incident plane wave are calculated for four slabs. The first three slabs are made up of individual resonant circuits. The fourth slab is made up of the three-resonant circuit meta-material. The magnitudes of the calculated transmission coefficients for slabs of thickness t=28.8 mm are shown in FIG. 18. More specifically, FIG. 18 shows the magnitude spectral behavior of the transmission coefficient of the normal incidence plane wave through each of the three individual resonant circuits and the composite three-layer EBG resonant medium. The spectral behavior of the transmission coefficient for the three-resonant circuit material clearly illustrates the merger of the three poles associated with each circuit, which has created a wide band-stop as desired. Loading the loop capacitors with a ferro-electric material makes the band-gap medium electronically tunable.

The resonant behavior of the periodic resonant circuit, as discussed previously, is responsible for the magnetic property of the embedded-circuit meta-material. This phenomenon occurs only where the incident magnetic field has a component along the axes of the loops. To remove this anisotropic behavior and generate an EBG structure with a band-gap property independent of angle of incidence and polarization state, one needs to design a three-dimensional (3-D) periodic composite embedded-circuit meta-material such as that shown in FIG. 19. The FDTD transmission coefficients for the normal incidence and an oblique incident plane wave with $\theta^i$=90°, $\phi_i$=150° and a linear polarization specified by the angle $\Psi^i$=40° (between the electric field and a reference direction $\hat{k}^i\times\hat{z}$) are plotted in FIG. 20. The independence of band-gap property to incidence angle and polarization is clearly demonstrated. Shown in FIG. 20 is also the transmission coefficient for a one-dimensional structure at the oblique incidence. As expected the band-gap behavior of the one-dimensional structure is not observed at the oblique incidence.

Design of a Bi-Anisotropic Meta-Material

In recent years bi-anisotropic materials have been the subject of extensive research for applications in antennas and communication systems. The greatest potential application of these materials is the suggested use of bi-anisotropic/chiral materials as the substrate or superstrate for printed antennas with enhanced radiation characteristics.

In this section it is shown that by inserting a different circuit geometry, a material with bi-anisotropic properties can be designed. By definition, a bi-anisotropic medium is both polarized and magnetized in an applied electric or magnetic field. In such a medium, the constitutive relationship is given by $$\begin{bmatrix} D \\ B \end{bmatrix} = \begin{bmatrix} \bar{\varepsilon} & \bar{v} \\ \bar{\gamma} & \bar{\mu} \end{bmatrix} \cdot \begin{bmatrix} E \\ H \end{bmatrix} \tag{16}$$

where D is the electric flux density, B is the magnetic flux density, $\bar{v}$ is the electro-magnetic parameter and $\bar{y}$ is the magneto-electric parameter. Equation (16) is the most general form of constitutive relationship for small signal (linear) electromagnetic waves. To magnetize a medium with an applied electric field, consider an equivalent circuit shown in FIG. 21A. An applied voltage across the transmission line will cause a current to follow through the branch that includes the capacitance $C_c$ and the inductance $L_p$. Since magnetic coupling exists between $L_1\Lambda_x$ and $L_p$, the portion of the displacement current that goes through this branch creates stored magnetic energy (within $L_1\Lambda_x$ and $L_p$). If a medium can be constructed with this circuit as its equivalent circuit, then it can be said that an applied electric field magnetizes the medium. Conversely, a current going through the series inductance $L_1\Lambda_x$ induces a voltage across $L_p$ which in turn forces a displacement current through the shunt capacitances ($C_c$). In other words, a magnetic field produces stored electric energy, and therefore a medium that has the circuit of FIG. 21A as its equivalent circuit is bi-anisotropic.

Figure 21A:
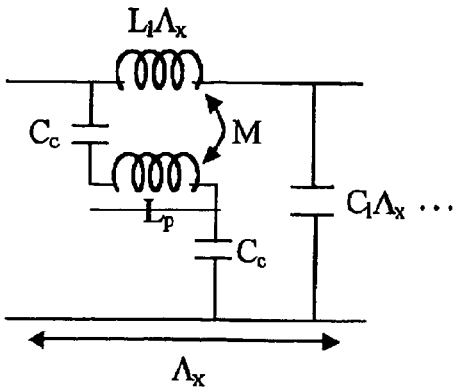
FIGS. 21A–21B illustrate a circuit configuration of a transmission line segment which allows for magnetic energy storage by displacement current and electric energy storage by conduction current in FIG. 21A, and in FIG. 21B an embedded-circuit transmission line for the equivalent circuit shown in FIG. 21A.
Figure 21B:
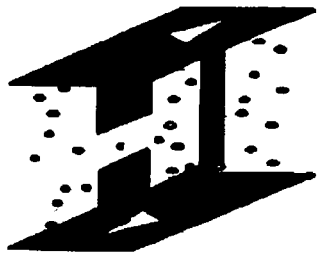

FIG. 21B shows the transmission line segment $\Lambda_x$ with a metallic circuit inclusion whose equivalent circuit is shown in FIG. 21A. Simple circuit analysis can be used to show that the differential equations governing the transmission line segment of FIG. 21A are given by $$\frac{dI}{dx} = j\omega[C_{eq}V + \gamma I]; \text{ and} \tag{17a}$$

$$\frac{dV}{dx} = j\omega[L_{eq}I - \gamma V]. \tag{17b}$$

Here $C_{eq}$ and $L_{eq}$ are the equivalent capacitance and inductance per unit length of the modified line of FIG. 21B, and are given by $$C_{eq} = C_l - \frac{1}{\Lambda_x}\frac{C'_c}{\omega^2 L_p C'_c - 1}; \text{ and} \tag{18a}$$

$$L_{eq} = L_l - \frac{1}{\Lambda_x}\frac{\omega^2 M^2 C'_c}{\omega^2 L_p C'_c - 1} \tag{18b}$$

where $C'_c=C_c/2$. Also $\gamma$, the magneto-electric parameter of the modified line, is given by $$\gamma = \frac{1}{\Lambda_x}\frac{j\omega M C'_c}{\omega^2 L_p C'_c - 1} \tag{19}$$

Expressions for $C_l$, $L_l$, $C_c$, $L_p$, and M are the same as those discussed above. Both the current and voltage that satisfy equation (17) are also solutions of a wave equation with the following propagation constant:

$$\kappa=\omega\sqrt{L_{eq}C_{eq}+\gamma^2} \tag{20}$$

The effective medium permittivity and permeability can easily be obtained from $C_{eq}$ and $L_{eq}$ and are determined according to $$\varepsilon_{eff} = \varepsilon + \frac{\Lambda_z}{\Lambda_x \Lambda_z} \frac{C'_c}{1-(\omega/\omega_b)^2} \tag{21a}$$

$$\mu_{eff} = \mu_0 + \frac{\Lambda_y}{\Lambda_x \Lambda_z} \frac{\omega^2 M^2 C'_c}{1-(\omega/\omega_b)^2} \tag{21b}$$

where $\omega_b = 1/\sqrt{L_p C'_c}$. The magneto-electric parameter ($\gamma$) for the effective medium is the same as the one derived for the equivalent transmission line.

Figure 22:
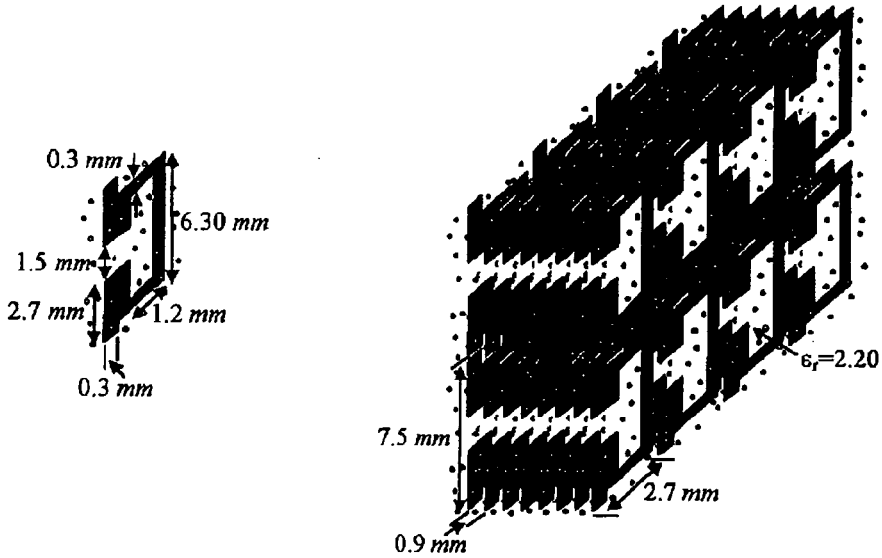
FIG. 22 illustrates a bi-anisotropic embedded-circuit meta-material.
Figure 23:
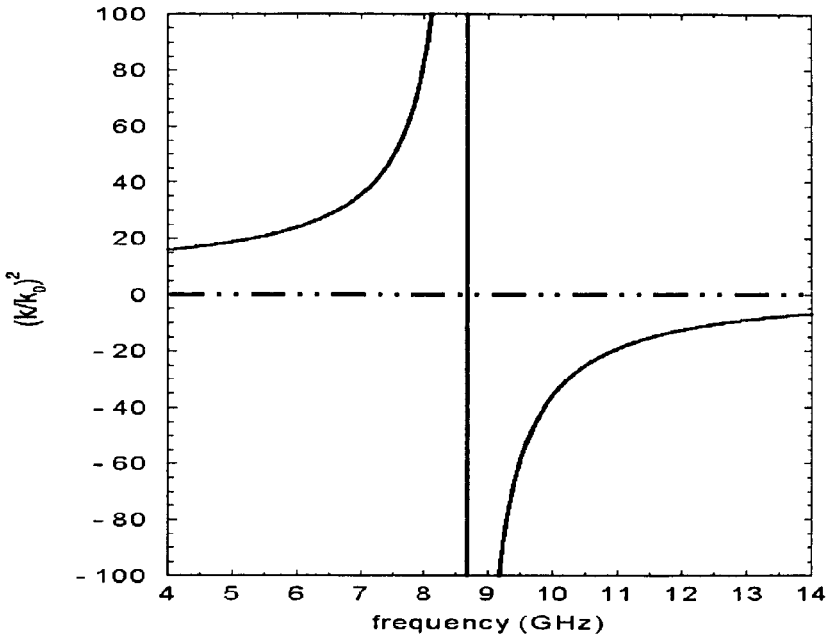
FIG. 23 illustrates normalized propagation constant of the bi-anisotropic material estimated from the twentieth equation (20)
Figure 24A:
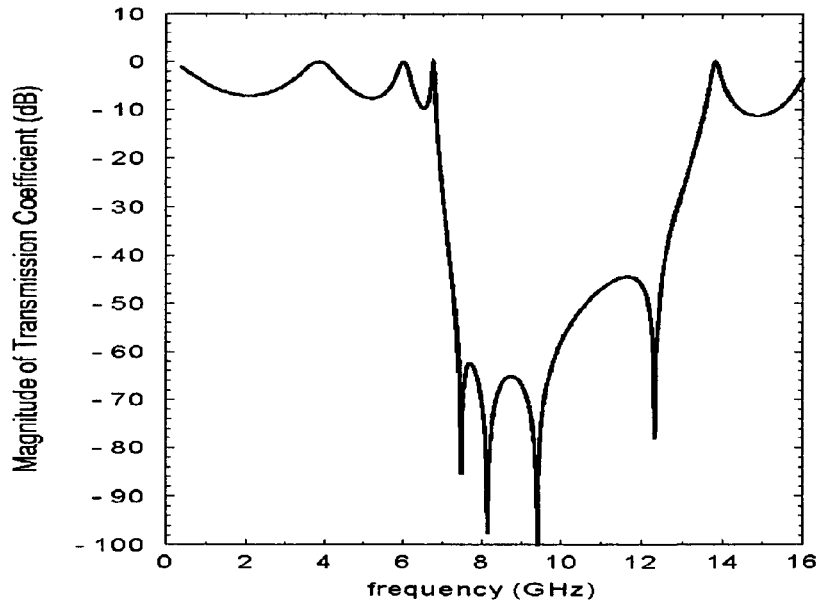
FIGS. 24A–24B illustrate, respectively, the magnitude and the phase spectral behaviors of the transmission coefficient for the normal incidence plane wave through the bi-anisotropic slab shown in FIG. 22.
Figure 24B:
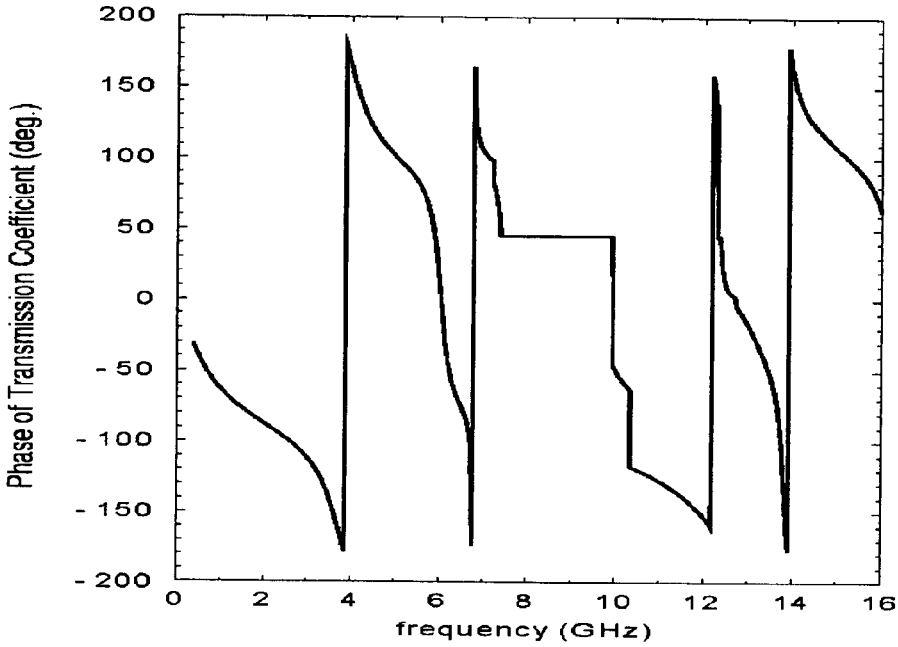

To design a bi-anisotropic medium, an embedded-circuit meta-material with a circuit topology depicted in FIG. 22 is examined. The normalized propagation constant $(\kappa/\kappa_0)^2$ of the medium is estimated from equation (20) and is plotted in FIG. 23 where $\kappa_0$ is the propagation constant in a vacuum. Both the effective permittivity and permeability of the bi-anisotropic material show a resonance characteristic (see equation (21)), and with a frequency range in which both $\epsilon_{eff}$ and $\mu_{eff}$ are negative. At a first glance, it appears that the medium is left-handed. However, due to the behavior of the magneto-electric parameter ($\gamma$), the wave constant $\kappa$ becomes imaginary in this frequency range, and the material shows band-gap characteristics. The FDTD technique is used to analyze this embedded-circuit meta-material. The magnitude and phase of the transmission coefficient through a slab of the material with thickness t=10.5 mm for normal incident wave is plotted in FIG. 24. The stop-band is in the region in which both $\epsilon_{eff}$ and $\mu_{eff}$ are negative. A tunable bi-anisotropic medium is achievable utilizing BST capacitors printed on both or one end of the wire loops as described with reference to FIG. 10.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An electro-ferromagnetic meta-material comprising:

a dielectric material; and a plurality of embedded resonant circuits arranged in a periodic structure within the dielectric material, each of the plurality of embedded resonant circuits including a metal loop having an arbitrary shape and size with at least one capacitive gap, the plurality of embedded resonant circuits defining means for varying permeability of an electro-ferromagnetic meta-material with an external direct current electric field.

2. The meta-material of claim 1, wherein each of the plurality of embedded resonant circuits has an identical resonant frequency in a plane perpendicular to a propagation direction, while being capable of having different resonant frequencies along the direction of propagation.

3. The meta-material of claim 1, wherein the dielectric material is a homogeneous dielectric material.

4. The meta-material of claim 1, wherein by varying a gap between the embedded resonant circuits along a direction of electric field polarization an effective permittivity of the meta-material can be adjusted.

5. The meta-material of claim 1, wherein the loop comprises at least two capacitive gaps, each of the two capacitive gaps located on an opposite leg of the metal loop, and wherein at least one of the two capacitive gaps is filled by a ferro-electric material.

6. The meta-material of claim 5, wherein the electronic tunable capacitor is supplied by one of diode and ferro-electric varactors.

7. An electro-ferromagnetic meta-material comprising:

a dielectric material;

a plurality of embedded resonant circuits arranged in a periodic structure within the dielectric material, each of the plurality of embedded resonant circuits including a metal loop having an arbitrary shape and size with at least one capacitive gap, wherein the loop includes at least two capacitive gaps each of the two capacitive gaps located on an opposite leg of the metal loop and wherein at least one of the two capacitive gaps includes an electronic tunable capacitor; and a DC electric field applied to the dielectric material for tuning the electronic tunable capacitor to vary the band-gap of the meta-material.

8. The meta-material of claim 1, wherein the plurality of embedded resonant circuits comprise a stack of periodically printed circuits on a substrate of dielectric material.

9. The meta-material of claim 1, wherein odd layers of the plurality of embedded resonant circuits have a first resonant frequency and even layers of the plurality of embedded resonant circuits have a second resonant frequency.

10. The meta-material of claim 9, wherein the loop comprises at least two capacitive gaps, each of the two capacitive gaps located on an opposite leg of the metal loop.

11. The meta-material of claim 1, wherein respective capacitive gaps of odd layers of the plurality of embedded resonant circuits have a first capacitive value and respective capacitive gaps of even layers of the plurality of embedded resonant circuits have a second capacitive value.

12. The meta-material of claim 1, wherein the plurality of embedded resonant circuits comprises a first layer of embedded resonant circuits, a second layer of embedded resonant circuits and a third layer of embedded resonant circuits; and wherein each of the first layer, the second layer and the third layer has a unique resonant frequency.

13. The meta-material of claim 12 further comprising:

a plurality of I-shaped metallic strips located between adjacent embedded resonant circuits for increasing an effective permittivity of the dielectric material between the adjacent embedded resonant circuits.

14. An electro-ferromagnetic meta-material comprising:

a dielectric material;

a plurality of embedded resonant circuits arranged in a periodic structure within the dielectric material each of the plurality of embedded resonant circuits including a metal loop having an arbitrary shape and size with at least one capacitive gap, wherein the plurality of embedded resonant circuits includes a first layer of embedded resonant circuits a second layer of embedded resonant circuits and a third layer of embedded resonant circuits; and wherein each of the first layers the second layer and the third layer has a unique resonant frequency, wherein adjacent embedded resonant circuits are separated by a distance equivalent to a quarter wavelength.

15. The meta-material of claim 14 further comprising:

a plurality of I-shaped metallic strips located between the adjacent embedded resonant circuits for increasing an effective permittivity of the dielectric material between the adjacent embedded resonant circuits.

16. The meta-material of claim 15, wherein a resonant frequency of the first layer is less than a resonant frequency of the second layer; and wherein the resonant frequency of the second layer is less than a resonant frequency of the third layer.

17. The meta-material of claim 16, wherein the periodic structure comprises a three-dimensional cube.

18. The meta-material of claim 12, wherein a resonant frequency of the first layer is less than a resonant frequency of the second layer; and wherein the resonant frequency of the second layer is less than a resonant frequency of the third layer.

19. The meta-material of claim 12, wherein each of the plurality of embedded resonant circuits further comprises a ferro-electric material filling the at least one capacitive gap.

20. The meta-material of claim 19, wherein the ferro-electric material comprises one of diode and ferro-electric varactors.

21. An electro-ferromagnetic meta-material comprising:

a dielectric material; and a plurality of embedded resonant circuits arranged in a periodic structure within the dielectric material, each of the plurality of embedded resonant circuits including a metal loop having an arbitrary shape and size with at least one capacitive gap, wherein the metal loop has a shape providing bi-anisotropic properties to the meta-material.

22. The meta-material of claim 21, wherein each of the plurality of embedded resonant circuits further comprises a ferro-electric material filling the at least one capacitive gap.

23. The meta-material of claim 21, wherein the at least one capacitive gap comprises two capacitive gaps, each of the two capacitive gaps located on an opposite leg of the metal loop, and wherein at least one of the two capacitive gaps includes an electronic tunable capacitor.

24. The meta-material of claim 23, wherein the electronic tunable capacitor is supplied by one of diode and ferro-electric varactors.

25. The meta-material of claim 14, wherein a wideband band-gap structure is provided.

26. The meta-material of claim 18, wherein a wideband band-gap structure is provided.

27. The meta-material of claim 26, wherein the periodic structure comprises a three-dimensional cube.

28. The meta-material of claim 26, wherein the periodic structure comprises a three-dimensional structure having an isotropic band-gap independent of a wave incidence angle and a polarization state.

29. The meta-material of claim 1, wherein adjacent embedded resonant circuits are separated by a distance equivalent to a quarter wavelength.

30. The meta-material of claim 25, wherein the periodic structure comprises a three-dimensional cube.

31. The meta-material of claim 25, wherein the periodic structure comprises a three-dimensional structure having an isotropic band-gap independent of a wave incidence angle and a polarization state.

* * * * *